US005505114A

United States Patent [19]

Lawson

[11] Patent Number: 5,505,114

[45] Date of Patent: Apr. 9, 1996

[54] SIMULATED MUSICAL RAINMAKER

[76] Inventor: Kathleen Lawson, 2915 Heidi Dr., San Jose, Calif. 95132

[21] Appl. No.: 238,436

[22] Filed: May 5, 1994

[51] Int. Cl.[6] ..... G10D 13/08

[52] U.S. Cl. ..... 84/404

[58] Field of Search ..... 84/402, 404; 446/409, 446/419

[56] References Cited

U.S. PATENT DOCUMENTS

| | | | |
|---|---|---|---|
| 408,635 | 8/1889 | Sommer | 84/404 |
| 2,738,697 | 3/1953 | Miller | 84/404 |
| 3,698,128 | 10/1972 | Moeser | 46/175 |
| 4,179,973 | 12/1979 | White | 84/402 |
| 4,306,485 | 11/1981 | Rudkin | 84/402 |
| 4,901,617 | 2/1990 | Malone et al. | 84/402 |
| 4,968,283 | 12/1990 | Montgomery | 446/419 |
| 5,212,331 | 5/1993 | Waldo | 84/404 |
| 5,237,903 | 8/1993 | Bein et al. | 84/404 |

OTHER PUBLICATIONS

*Making Musical Things,* Wiseman, Ann. Charles Scribner's Sons: New York 1979 p. 25.

Rainsticks, S&S Worldwide, Inc., S&S Arts & Crafts catalogue p. 44, Instruction sheet, 1993.

*Primary Examiner*—Patrick J. Stanzione

[57] ABSTRACT

A lightweight, disposable musical toy for school-age children with a long brush-like baffle inserted into the casing that creates the sound of rain as particulate material flows through the baffle. Visual and aural enhancements include a brightly colored coveting, a molded covering of plants and animals from the rainforest, a clear casing through which the viewer sees the particulate material flowing through the baffle, and one or more sound circuits that broadcasts the sound of rain, animal calls, or musical instruments which is activated when the casing is tipped.

7 Claims, 13 Drawing Sheets

SIMULATED MUSICAL RAINMAKER

FIELD OF THE INVENTION

The present invention relates to simulated musical toys and especially to a simulated musical rainmaker for school-age children and other people for amusement and education which maintains the dimensions of a conventional rainmaker without diminishing any of its qualities.

The present invention overcomes the prior art by providing a simple elongated-core-baffle means disposed within the hollow casing of the present invention along the entire length thereof and in one embodiment incorporates visual and aural enhancement to a conventional rainmaker.

DESCRIPTION OF THE PRIOR ART

Heretofore, conventional rainmakers were the shape of a long hollow casing of natural material such as a reed or cane. Multiple pegs were inserted into the side wall of the hollow casing extending from side to side of the casing substantially along the length thereof or multiple chambers were disposed intermediate the two opposing ends of the casing to break the fall of particulate material as it flowed from one end of the casing to the other end when the casing was inclined away from the horizontal in order to create a pleasing rain sound. Particulate material such as dried seeds, shells, sand, etc., were placed inside the casing before the two opposing ends were sealed with a plug.

Conventional rainmakers were also made with a length of dried plant material in which sharp spines were inserted into the dried casing substantially along the entire length thereof to create a maze for the particulate material to flow through so as to generate the sound of rain.

Conventional rainmakers required hand-craft woodworking skills and were made as a durable good similar to a piece of furniture. Conventional rainmakers were intended for use by musicians during musical performance.

Conventional rainmakers were built of natural materials that are hard and cause injury to a person, if used improperly by a child as a hitting tool. Conventional rainmakers 3 feet in length which is an exemplary length for the conventional rainmaker were too expensive for most people to buy for children as a musical play toy.

Many hand-held percussion instruments, musical toys, and devices have been devised over the years disclosing features of the rainmaker.

U.S. Pat. No. 2738,697 issued to M. F. Miller on Mar. 20, 1956, and U.S. Pat. No. 408,635 issued to F. A. Sommer on Aug. 6, 1889, disclosed a long sound producing structure with a percussion element striking sonorous vibratory plates as the percussion element flows by gravity through a serpentine passage. These devices do not imitate the sound of rain.

U.S. Pat. No. 4,306,485 issued to Rudkin on Dec. 22, 1981, U.S. Pat. No. 3,698,128 issued to Moeser on Oct. 17, 1972, U.S. Pat. No. 4,968,283 issued to Montgomery on Nov. 6, 1990, and U.S. Pat. No. 4,179,973 issued to White on Dec. 25, 1979, all disclosed a rattle type device comprising a hollow casing filled with particulate material that creates sound when the device is shaken and the particulate material strikes the interior walls of the device. These devices are not rainmakers producing an organized sound identifiable as rain or running water.

U.S. Pat. No. 4,901,617 issued to Malone et at. on Feb. 20, 1990, disclosed a hand-held percussion instrument which allows for the creation of many musical noises by scraping, shaking, plucking, striking, and bowing the instrument. This device is a general percussion instrument. The rain sound is generated for a relatively short duration due to the length of the instrument.

U.S. Pat. No. 5,212,331 issued to Waldo on May 18, 1993, disclosed a multi-chambered rainmaker with sensing arm which controls the flow of the particulate material as it flows from one chamber to the next. The instrument was constructed of wood. The internal mechanism adds to the heaviness of the device which was intended for adult performing musicians. It is unsuitable for children's amusement and likely to be expensive to buy as a play toy.

U.S. Pat. No. 5,237,903 issued to Bein et al. on Aug. 24, 1993, disclosed a rain sound simulator with a hollow drum head filled with particulate material fixed on a short handle centrally attached to the dram head. This device does not maintain the traditional length of the rainmaker. Children desire the tactile experience of tipping a rainmaker over and over again. The shape and outside covering is designed for use in performance. It is not used as an educational tool children may draw on or see designs depicting animals and plants from the rainforest where the conventional rainmaker originates.

Two prior art references found in boob apply most directly to the simulated musical rainmaker disclosed in this application.

One rattle instrument was made of a clear plastic mailing tube about 1 foot long. Wire was sown through the tube to create a maze for rice, beans, or pebbles to go through. An alternate design disclosed pins or nails inserted into the tube to create the maze. This device made of pins, nails, or protruding wire was unsafe for children to make in a classroom or to play with. The rainmaker may break apart as the casing deteriorates causing the nails, pins, or protruding wire to come in contact with the children. The rainmaker is not durable.

Another rattle instrument was made of a 15 in. paper tube with toothpicks inserted from side to side at varying angles along the entire length of the tube. Children were instructed to use a pin to create holes in the paper tube. This method is unsafe for children because it requires the used of hazardous tools to make the holes through which the toothpicks are inserted. The rainmaker contains hazardous parts that may come in contact with the children when the hollow casing begins to deteriorate. The construction method imitates prior art and becomes tedious for a full length 3 foot rainmaker. The rainmaker 3 feet in length constructed by said methods takes 4 hours or more to complete. The rainmaker is not durable.

Therefore, adults, educators, children, and those learned in the art will appreciate a handmade rainmaker of simple construction, easy to make in a short time, pleasing in appearance and sound, low in cost, relies on the use of relatively safe tools and produces no hazardous parts when the casing of the rainmaker deteriorates. They would also like to buy at low cost a manufactured simulated musical rainmaker which is colorful and has attractive features, is more durable than simulated musical rainmakers made heretofore, that produces the sound of rain by an electronic sounding means, a rainmaker that may be tipped end over end yet maintain the sound of rain for a relatively long duration since the sound is generated electronically rather than by a mechanical process depending on friction between parts to create the sound, a rainmaker that will maintain the sound of rain for a relatively long duration without further human interaction once the circuit has been activated.

BRIEF DESCRIPTION OF THE INVENTION

The present invention in a preferred embodiment is a hand-made simulated musical rainmaker comprising a hollow casing with first and second closed opposing ends. The hollow casing may have many cross sectional shapes such as circular or a polygonal shape such as triangular, square, pentagonal, hexagonal, etc. Although the circular casing is most frequently depicted and described throughout the several drawings, it will be understood that any shape may be used to form the cross sectional diameter of the said casing.

An elongated-core-baffle means is disposed inside the hollow casing intermediate the two opposing ends occupying the entire length thereof which has three functions: the elongated-core-baffle means gives structural support to the inside wall of the casing; the elongated-core-baffle-means slows the movement of the particulate material as such particulate material flows through the elongated-core-baffle means from the first end of the casing to the second end; the elongated-core-baffle-means creates a unique rushing or hissing sound cause by friction when the particulate material impinges on the elongated-core-baffle means. The sound thus produced is similar to rain or water running from a faucet.

The elongated-core-baffle-means has a simple construction that can easily be made by school-age children. When the elongated-core-baffle means is inserted in spiral fashion into the hollow casing many small openings are created through which the particulate material freely moves as it flows from the first end of the casing to the second end.

The elongated-core-baffle means may have many different 3-dimensional configurations. It can be made with many materials including but not limited to materials that may be folded and cut, materials forming a mesh, or a honeycombed material with small holes and paths permitting particulate material to flow freely through the hollow casing. The elongated-core-baffle means and the hand-made simulated musical rainmaker of the present invention takes about one hour to create which is faster than methods used in the prior art.

The end closing means of the hollow casing can be made from many materials and formed in several configurations. The end closing means are lightweight and easily purchased at low cost in stores.

The materials used to make the simulated rainmaker are comprised of natural, organic, or recycled materials primarily. The simulated musical rainmaker uses materials that are abundant in northern temperate geographic areas such as the United States and Europe. This is an important factor in the manufacture of the simulated musical rainmaker so as to ensure natural resources in other countries are not depleted to serve the demand for rainmakers in industrialized countries who import rainmakers.

Particulate material of many shapes, sizes, and colors is loosely disposed and freely movable within the hollow interior of the casing. These materials can be gathered out-of-doors or purchased at a low cost in stores.

Safety is an important factor in the hand-made simulated musical rainmaker. Currently teachers and child care providers give children paper tubes filled with nails or use construction methods and materials such as toothpicks inserted into tubes at the pre-school level. Older children use ice picks to create the holes needed to make a disposable rainmaker. The present invention only requires the use of paper scissors which are regularly used in classrooms and at home.

The decorative covering is very colorful. It may consist of any pigment such as poster paint, ink, dye, etc., or a thin material such as wrapping paper, color tape, or stickers that may be applied to the outside of the casing. The decorative covering may be a variable bumpy 3-dimensional shape to emphasize the animals and plant life of the rainforest or any other ecological and geographic environments the children learn about in class.

The decorative covering of the simulated musical rainmaker is useful as an educational tool. When constructing simulated musical rainmakers in the classroom, school age children draw their own plant and animal designs as a reinforcement to lessons they have received on the rainforest or any other ecological and geographical environments. The simulated musical rainmaker of the present invention is a very useful object to introduce multi-subject curriculum in schools. The simulated musical rainmaker generates interest in science, music, culture, literature, etc.

Another embodiment of the present invention discloses an article of manufacture that incorporates visual and aural enhancement to the conventional rainmaker. The embodiment has a clear casing with closed, first and second, opposing ends. The elongated-core-baffle means of the present invention becomes an attractive focal point for the user since it may be shaped in a symmetrical or irregular configuration within the casing to reinforce the experience of seeing particulate material flow through the elongated-core-baffle means within the said casing.

The particulate material is made of weighted material of bright colors, including bright fluorescent colors that glow in the dark, which can be seen through the clear casing. The particulate material is another focal point as it may be composed of particles of different colors mixed together. The colors of the particulate material are made to contrast against the color of the elongated-core-baffle means. This contrast creates a pleasing sensation in the user who is watching the colorful particulate material flow through the elongated-core-baffle means.

Sound reinforcement is included with the present embodiment by means of an electronic sounding means. The electronic sounding means plays the rain sound when the casing is moved away from the horizontal position. The electronic sounding means reinforces the rain sound produced mechanically by the weighted particulate material falling against the elongated-core-baffle means inside the casing.

Another embodiment of the present invention is a molded 3-dimensional casing of a fanciful shape in any size that represents plants or animals from the rainforest or any other ecological or geographical environment. The molded casing has colors and forms to help children visualize the rainforest environment or other environments.

The addition of the electronic sounding means to a simulated musical rainmaker makes it possible to manufacture simulated musical rainmakers of many different shapes and sizes. For example, the present invention may be miniaturized without diminishing the duration of the rain sound. The electronic sounding means may replace and make redundant the elongated-core-baffle means which creates the sound of rain by a mechanical process using friction between the particulate material and the elongated-core-baffle means to produce the rain sound. The fanciful shape and decorative covering of the present invention distinguishes the simulated musical rainmaker from the prior art.

The electronic sounding means makes it possible to sustain the sound of rain for a period of time without human interaction once electronic sounding means has been activated. The rain sound persists as long as a charge is maintained in the circuit of the electronic sounding means.

Another embodiment of the present invention mentioned but not represented in the drawings discloses a rainmaker with one or more electronic sounding means or sound circuits which create the sounds of animals such as a macaw, monkey, lion, etc., nature sounds such as wind, or instrumentation such as flute or drums in combination with the rain sound.

OBJECTS AND ADVANTAGES

Accordingly I claim the following as the objects and advantages of the invention: to provide a simulated musical rainmaker with a simple elongated-core-baffle means that has three functions: 1) the elongated-core-baffle means strengthens the inside wall of the casing; 2) the elongated-core-baffle-means slows down the particular material as it flows by gravity from one end of the casing to the other end; and 3) the elongated-core-baffle means creates a unique rushing or hissing sound identifiable as rain or running water as the particulate material causes friction on the elongated-core-baffle-means as it flows through the casing; to provide a hand-made or manufactured rainmaker that is lighter in weight over prior art of the same dimensions, low in cost, disposable, requires less time to make, safe for children's amusement and education, made with common recycled paper and reused materials; to provide a simulated musical rainmaker children with a simple skill level can make by themselves once they have seen it, and provide a rainmaker that relies on relatively safe tools and contains no hazardous parts when the casing of the rainmaker begins to deteriorate, to provide a manufactured simulated musical rainmaker with the same qualities of the first embodiment such as low cost, lightweight, safe to use, made with recycled materials, a manufactured simulated musical rainmaker with fanciful shapes and sizes that incorporates visual and aural enhancement to a conventional rainmaker, a rainmaker that maintains the length of a traditional a simulated musical rainmaker that sustains the sound of rain without further human interaction once the circuit of the electronic sounding means is activated.

Conventional rainmakers are relatively heavy and made as a durable good as an instrument for musicians to use during performance. Their weight makes them undesirable and unsuitable for children to use as a play toy. Most conventional rainmakers rely on the use of natural resources in tropical lands that may be diminished in order to satisfy the demand for rainmakers in countries where such materials are relatively scarce such as the United States and Europe. Conventional rainmakers require highly skilled woodworking tools to create. In addition, simulated musical rainmakers of the prior an require hazardous tools to make the rainmaker and produce hazardous parts when the casing of the rainmaker begins to deteriorate. The methods used to create simulated musical rainmakers heretofore are tedious for an exemplary full length rainstick of 3 feet. These methods imitate prior an and require 3 or 4 hours to complete a single rainmaker.

Readers will further discover the objects and advantages of the invention from consideration of the ensuing description and the accompanying drawings.

DESCRIPTION OF THE PREFERRED EMBODIMENT

Figures 1, 2:
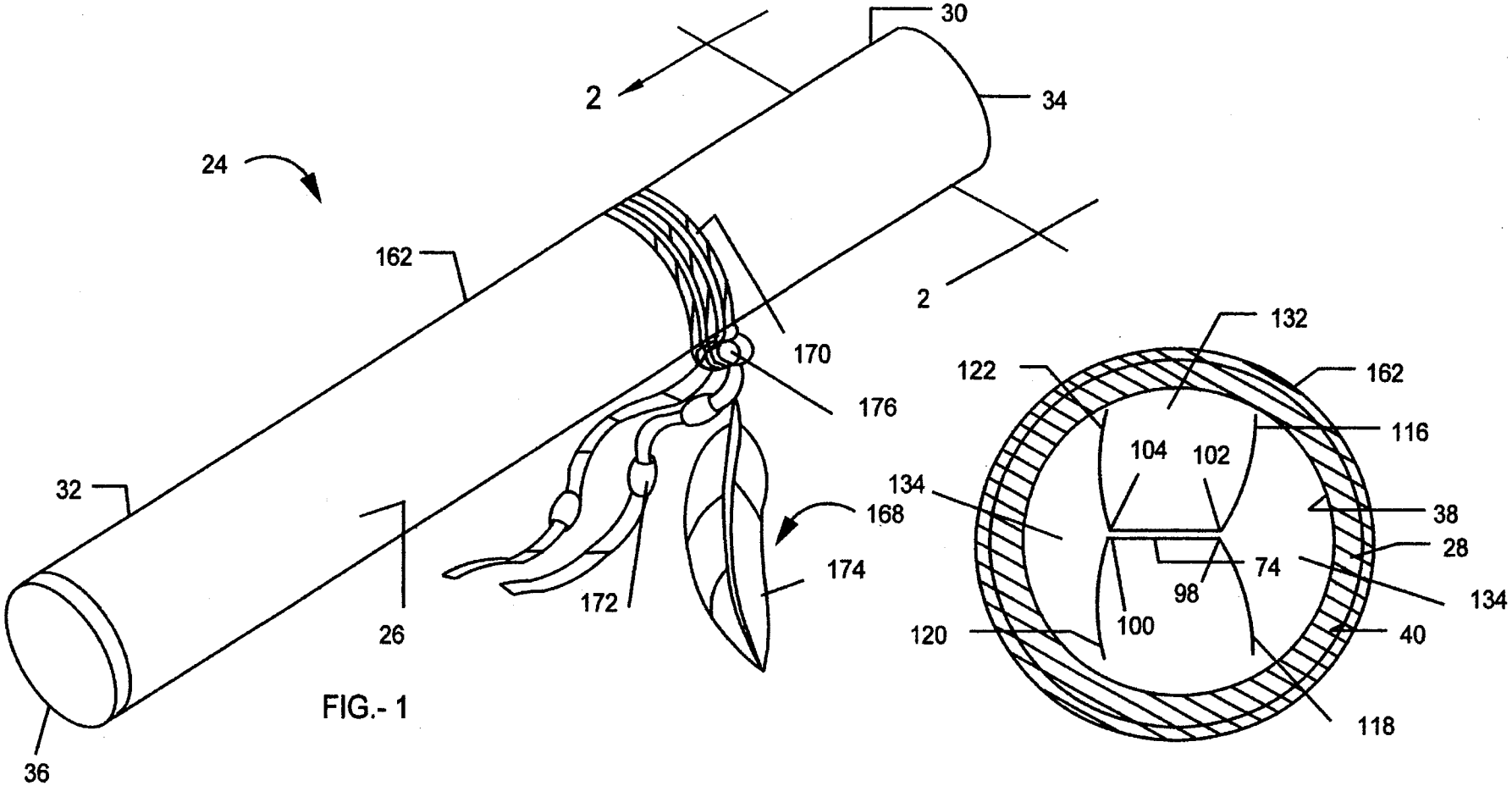
FIG. 1—Rainmaker is a perspective view of a simulated musical rainmaker constructed according to the teachings of the present invention.
FIG. 2—Circular Cross Section—is a cross sectional view generally taken along line 2—2 in FIG. 1.

Referring now to the drawings in detail wherein like reference characters indicate like parts throughout the several figures the reference numeral 24 indicates a simulated musical rainmaker constructed in accordance with the teachings of the invention.

Hand-Made Simulated Musical Rainmaker—Description

In FIGS. 1–8 there is depicted a simulated musical rainmaker 24 which generates a pleasing musical sound and more particularly the sound of rain or rushing water. The simulated musical rainmaker 24 is in the form of a hollow casing 26 which may be formed of any suitable material such as paper board, plastic, or metal such as aluminium that is light weight and made fully or partially of recycled materials. For example, a conventional paper spiral tube could be employed as the material forming the hollow casing 26.

The hollow casing 26 may have any suitable length such as 2 inches or 7 feet. Further, the cross sectional diameter of hollow casing 26 may range typically from ½ inch to 3 inches. In FIG. 1—Rainmaker a preferred embodiment of the present invention is depicted with a 2 inch cross sectional diameter.

Figure 20:
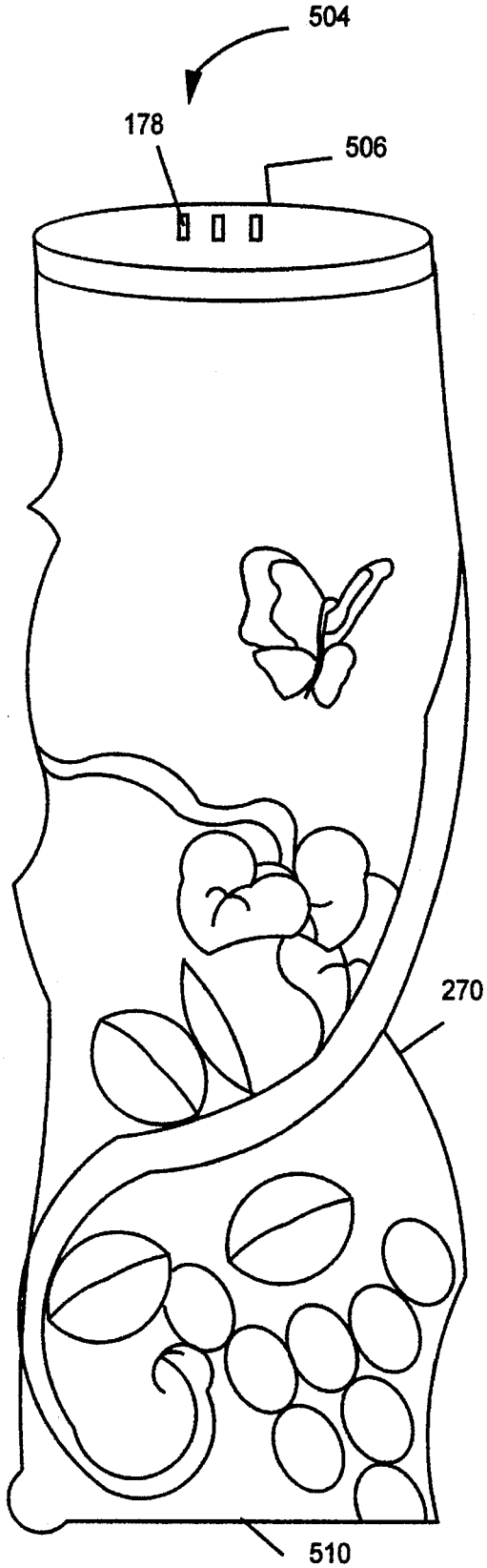
FIG. 20—Molded Rainmaker—is longitudinal view of another embodiment of the hollow casing or hollow container of a simulated musical rainmaker shown in FIGS. 1 and 9.

The hollow casing 26 may have any cross sectional shape such as circular, triangular, square, pentagonal, and a variable irregular shape resulting from the use of embossed paper or molded plastic. An example of an irregular cross sectional shape is best shown in FIG. 20— Molded Rainmaker. Although a circular cross sectional shape is illustrated most frequently in the drawings and described hereafter, it will be understood that this shape is shown and described by way of example only as any other shape may be employed in the construction of the simulated musical rainmaker of the present invention.

FIG. 1—Rainmaker—shows the preferred embodiment of the invention including a decorative tie 168 used for aesthetic appeal. Thus in the preferred embodiment of the present invention the hollow casing 26 is formed of a paper spiral tube of recycled paper made according to conventional manufacturing techniques. The side wall 28 of the hollow casing 26 may vary in thickness. The side wall 28 is best shown in FIG. 2—Circular Cross Section. FIG. 2—Circular Cross Section— is a view of the hollow casing 26 and the elongated-core-baffle means 68 taken along lines 2—2 of the present invention. For example, the simulated musical rainmaker depicted in FIG. 2—Circular Cross Section—has a 1/16 inch thickness.

As shown in FIG. 1—Rainmaker—the hollow casing 26 has first and second opposing ends 30 and 32, respectively. The first and second ends 30 and 32 are closed by first and second end closing means 34 and 36 that may be made of paper board, soft or hard plastic, shrink wrap, or tape. In the present invention the first and second end closing means 34 and 36 are formed of one piece of recycled molded polyethylene.

Figure 3:
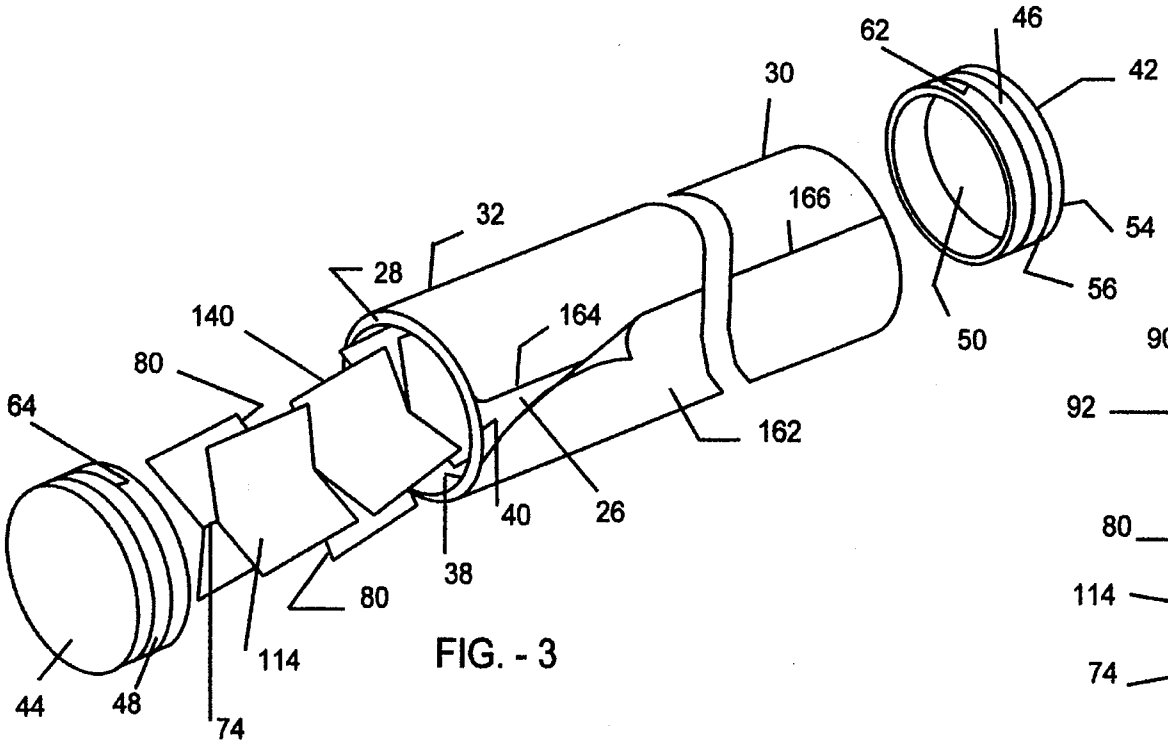
FIG. 3—Rainmaker Assembly—is an enlarged, perspective view of the assembly of the simulated musical rainmaker shown in FIG. 1.
Figure 7:
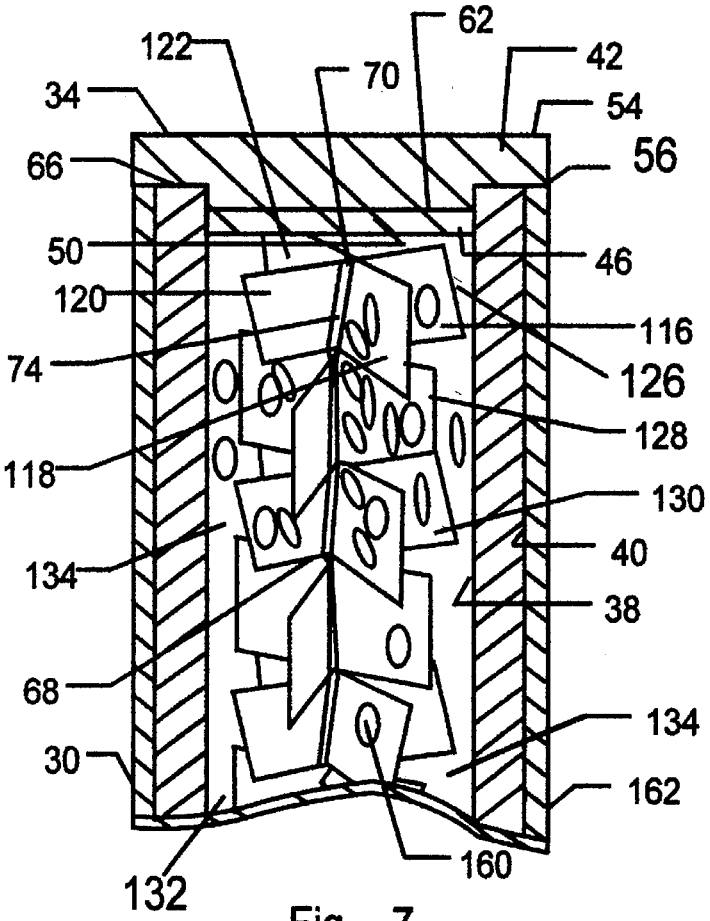
FIG. 7—Partial Cross Section of Rainmaker—is an enlarged, partial, cross sectional view of the end closing means attachment of a simulated musical rainmaker shown in FIG. 1.

FIG. 7—Partial Cross Section of Rainmaker—shows in detail the construction of one end closing means, such as end closing means 34. The top 42 of end closing means 34 has a 2 inch diameter and is about 1/16 inch in thickness. The top 42 of end closing means 34 has a sleeve 46 recessed about 1/16 inch from the outside edge 54 of the bottom face 56 of top 42. Likewise, the second end closing means 36 has a top 44 and sleeve 48 identical to end closing means 34. Sleeve 46 has a hairline indentation 62 on the outside surface 50 of the sleeve 46 of the end closing means 34 so that the sleeve 46 can be deformed by slight pressure and made to fit securely in the first end 30 of the casing 26. Likewise, sleeve 48 has a hairline indentation 64 identical to sleeve 46. The cross sectional shape of the sleeves 46 and 48 are made to conform to the inside wall 38 of the ends 30 and 32, respectively, of hollow casing 26 which is best shown in FIG. 3—Rainmaker Assembly.

For example, the sleeve 46 of the end closing means 34 depicted in FIG. 7—Partial Cross Section of Rainmaker—is a circular shape 2 inches in diameter conforming with the first end 30 of hollow casing 26.

Figure 5:
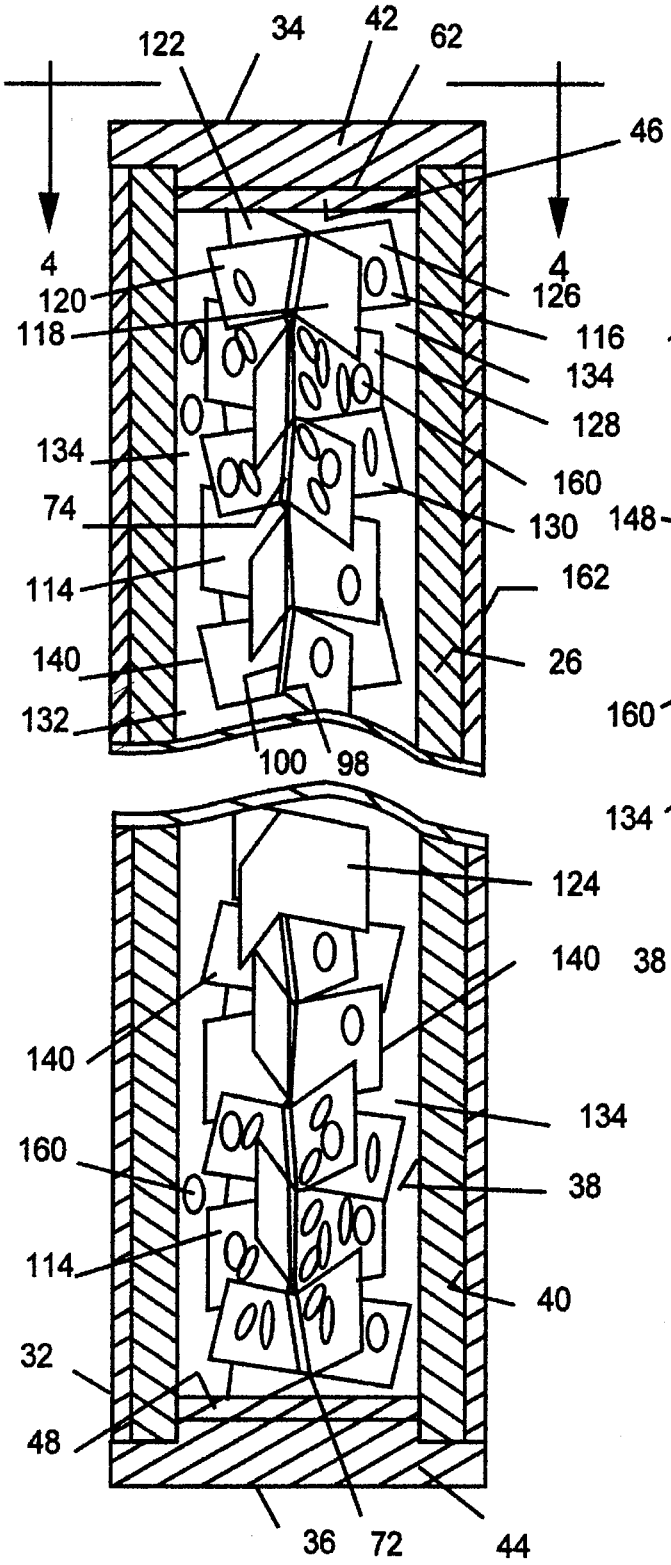
FIG. 5—Longitudinal View—is a longitudinal, cross sectional view of the simulated musical rainmaker shown in FIG. 1.

FIG. 5—Longitudinal View—best shows the end closing means 34 and 36 fitting into the ends 30 and 32, respectively, of the hollow casing 26. Sleeve 46 of the top 42 of end closing means 34 protrudes into the end 30 of the hollow casing 26 by ¼ inch whereby the side wall end 66 abuts against the bottom face 56 of the outside edge 54 of of the top 42 of end closing means 34. The end closing means 34 and 36 are attached to the ends 30 and 32, respectively, by the pressure of the sleeves 46 and 48 exerted on the inside wall 38 of the hollow casing 26. Additionally, the end closing means 34 and 36 may be secured to ends 30 and 32, respectively, of the hollow casing 26 by an adhesive.

FIG. 5—Longitudinal View—depicts an elongated-core-baffle means 68 with a plurality of tabs 114 inserted substantially along the entire length of the hollow casing 26. The elongated-core-baffle means 68 may be formed of paper, hard or soft plastics such as Lucite, polypropylene and polyethylene, respectively, chicken wire, aluminum mesh, or any suitable material that may be cut, bent, twisted or formed with small openings through which particulate material freely moves.

In FIG. 5—Longitudinal View—the elongated-core-baffle means 68 is formed in one of many possible configurations. FIG. 5—Longitudinal View—shows the preferred embodiment of the present invention. The elongated-core-baffle means 68 is made of a predetermined number of strips of paperboard. By way of example, the elongated-core-baffle means 68 is constructed of first and second strips 76 and 78, respectively, of paperboard 20 mils thick and 36 inches in length best shown in FIG.4—Core Development. The strips 76 and 78 are joined with adhesive along a longitudial line down the core 74 of strip 76. The first end 136 of the paper core 74 and the second end 138 of the paper core are identical to each other on both strips 76 and 78. A plurality of horizontal slits 80 are cut into the joined strips 76 and 78 at a length of 1 inch on the first and second sides 88 and 90 of the joined strips 76 and 78. The plurality of slits 80 are equally spaced longitudinally at a predetermined interval.

Figure 4:
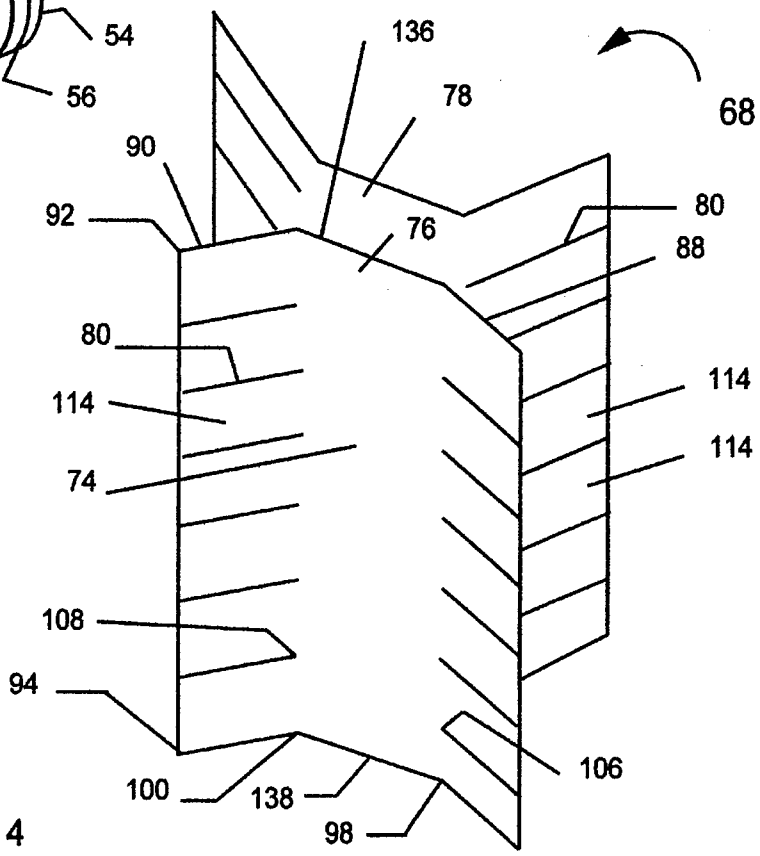
FIG. 4—Core Development—is an enlarged, perspective view of two paperboard strips comprising the elongated-core-baffle-means of a simulated musical rainmaker shown in FIG. 1.

For example, in FIG. 4—Core Development—the slits 80 are longitudinally spaced ⅞ inch apart. After cutting the joined strips 76 and 78, a core 74 ½ inch wide and 36 inches long of contiguous paper is formed. In the preferred embodiment there are 47 slits 80 made on each side 88 and 90 of the strips 76 and 78. Between the top and bottom edges 92 and 94, respectively, of the strips 76 and 78 and the slits 80 a plurality of rectangular paper tabs 114 on sides 88 and 90 of core 74 are formed.

In the preferred embodiment, there are 48 tabs 114 on each side 88 and 90 of the elongated-core-baffle means 68. The two strips 76 and 78 are cut at the same time and formed identically.

FIG. 2—Cross Sectional View—shows the disposition of the tabs 114 in the hollow interior 132 of the casing 26. A predetermined number of tabs 114, such as tabs 116, 118, 120, and 122, are folded outward in opposing directions. The tabs 114 are formed by two folds 98 and 100 on strip 76 that extend substantially along the entire length of the strip 76. The tabs 114 of strip 76 are formed by folding the outermost tab ends 140 on sides 88 and 90 toward the paper core 74 at the bases 106 and 108 of the slits 80 of the first and second sides 88 and 90, respectively, of strip 76. Likewise the tabs 114 on the second strip 78 are formed by folding the outermost tab ends 140 inward toward the core 74 at the bases 110 and 112 of the strip 78.

The tabs 114 are disposed so that the outermost tab ends 140 extend to and may touch the inside wall 38 of the hollow casing 26.

FIG. 5—Longitudinal View—shows the tabs 114 arranged in rows 124 along the length of the hollow casing 26. Specially, consecutive tabs 116, 118, 120, and 122 are folded in four opposing directions to constitute the first row 126 of the elongated-core-baffle means 68. In the present invention there are 48 rows 124 numbered consecutively 1, 2, 3, 4, etc., such as rows 126, 128, 130, etc., of the elongated-core-baffle means 68. The plurality of tabs 114 partition the hollow interior 132 of casing 26 thereby creating a plurality of openings 134.

The elongated-core-baffle means 68 is inserted into the hollow casing 26 extending along its entire length so that the first and second ends 70 and 72 of the elongated-core-baffle means 68 are placed in the first and second ends 30 and 32, respectively, of the hollow casing 26. The core 74 is twisted in a spiral fashion so that the tabs 114 of one row, such as the first row 126, are offset by ¼ inch from the tabs 114 in the following row, such as row 128. Likewise the tabs 114 in row 128 are offset by the tabs 114 in row 130, etc.

FIG. 5—Longitudinal View—best shows tabs 114 of the first row 126 offset by ¼ inch from the tabs 114 of row 128, etc. Further, the outermost tab ends 140 extend to and may touch the inside wall 38 of the hollow casing 26 thereby structurally supporting casing 26.

Figure 6:
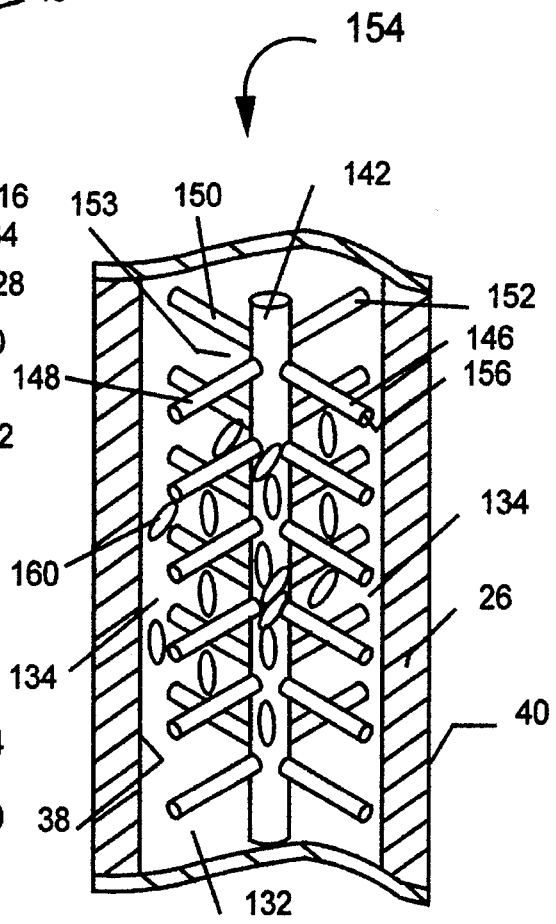
FIG. 6—Alternate Elongated Core—is a partial, cross sectional view of another embodiment of the elongated-core-baffle means of a simulated musical rainmaker shown in FIG. 1.

FIG. 6—Alternate Elongated Core—shows another embodiment of the elongated-core-baffle means 68. The core 142 is formed of one piece of molded soft or hard plastic. The core 142 is any suitable cross-sectional shape such as circular, triangular, square, etc. By way of example, the cross sectional shape of the core 142 of the elongated-core-baffle means 154 is circular as shown in FIG. 6—Alternate Elongated Core. A predetermined number of extensions 144 in a predetermined number of opposing directions project outward from the plastic core 142. The extensions 144 are spaced evenly a predetermined distance along the longitudinal axis of core 142. By way of example, consecutive extensions 146, 148, 150, 152, etc., form the first row 153 of the core 142. All extensions 144 are evenly spaced every ¼ inch along the entire length of core 142. There are a total of 136 rows 153 along the length of the core 142.

Specially one of the extensions 144, shown in FIG. 6—Alternate Elongated Core—extends from the core 142 to the inside wall 38 of the hollow casing 26. The outermost extension end 156 of the extension 146 is spaced from the inside wall 38 by a small opening 134. The extensions 144 partition the hollow interior 132 of the casing 26 so as to create a plurality of openings 134.

Figure 9:
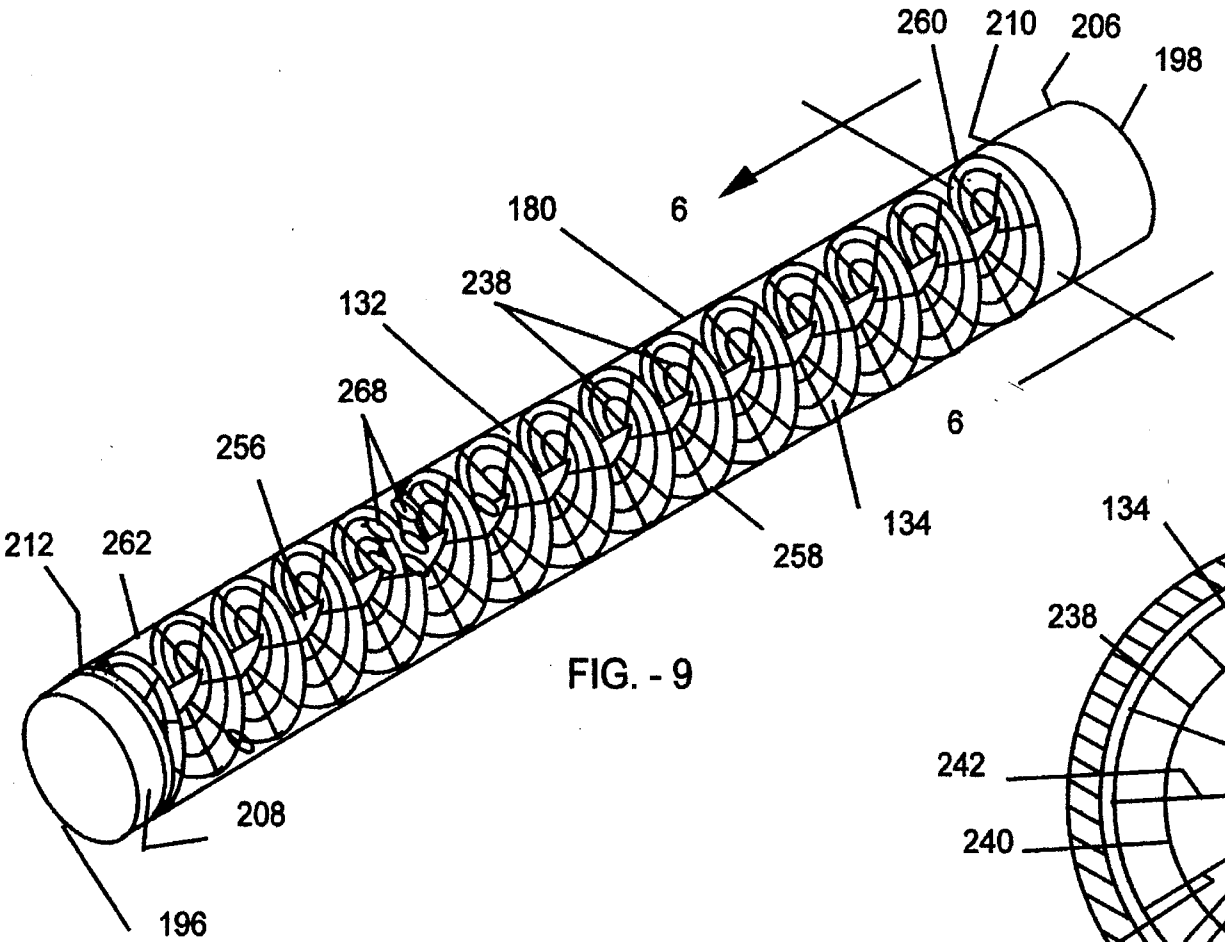
FIG. 9—Plastic Rainmaker—is a perspective view of a simulated musical rainmaker according to another embodiment of the present invention.
Figure 10:
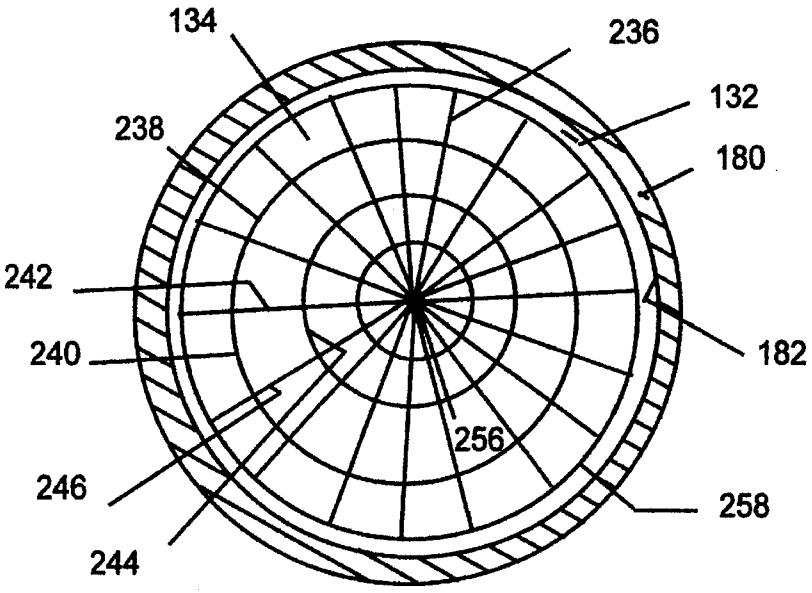
FIG. 10—Mesh Loop—is an enlarged, cross sectional view generally taken along line 6—6 in FIG. 9.
Figure 11:
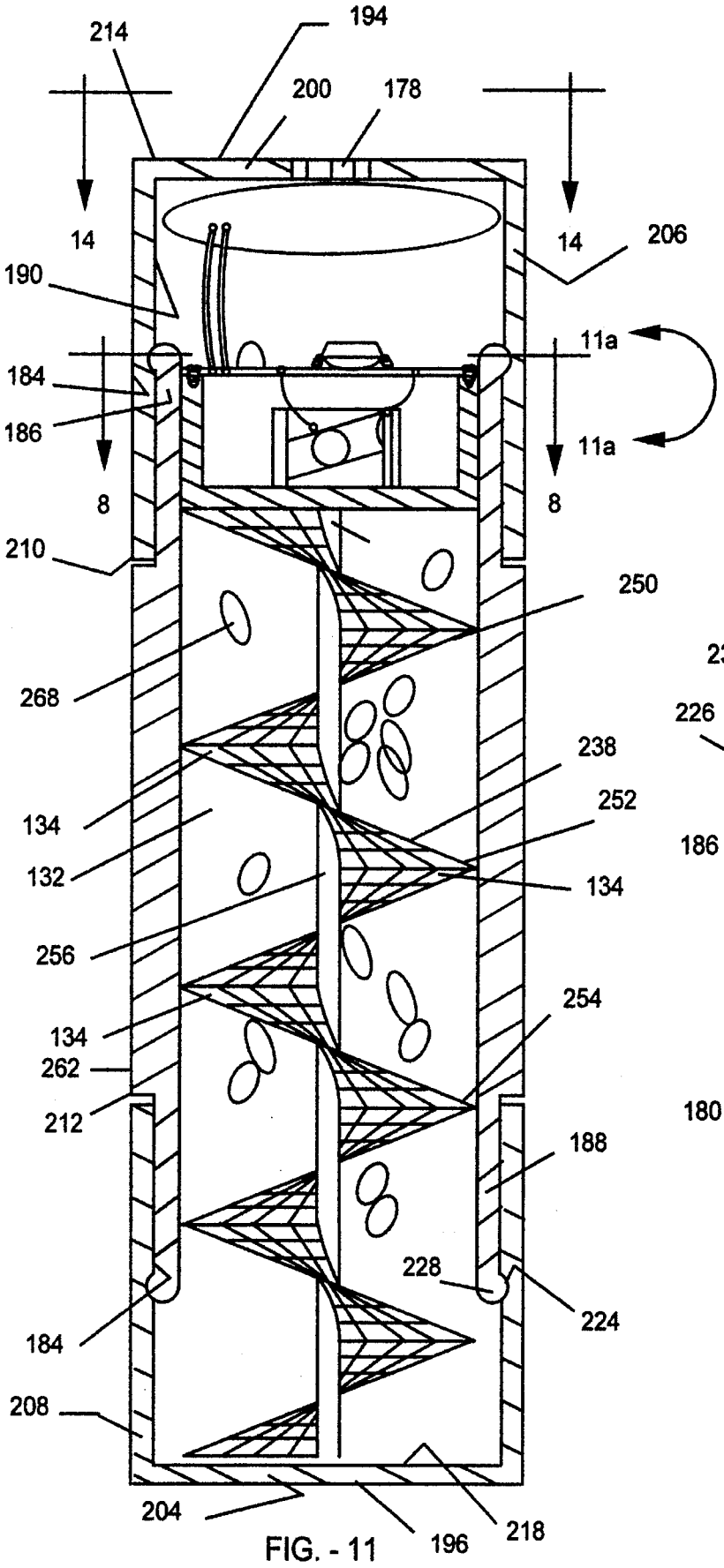
FIG. 11—Longitudinal View of Plastic Rainmaker—is a longitudinal, cross sectional view of the simulated musical rainmaker shown in FIG. 9, with FIG. 11*a*—Closing Detail—showing an enlarged view of the end closing means attachment to the casing.

FIGS. 9, 10, and 11 show a third possible embodiment of the elongated-core-baffle means 68 which will be described in detail in section 2—Plastic Simulated Musical Rainmaker further on. A fourth possible embodiment mentioned by not shown in the several figures consists of a honeycombed plastic material having many small openings and intersecting paths similar to a sponge that allows particulate material to move freely through the casing.

Although only four possible configurations have been mentioned and only three have been depicted herein, it will be understood that any suitable material with small openings 134 can be used to form the elongated-core-baffle means 68 of the present invention.

A predetermined quantity of particulate material 160 is loosely disposed in the hollow interior 132 of the casing 26 and flows freely through the elongated-core-baffle means 68 or 154 extending along the entire length of the casing 26. The particulate material 160 may be any organic hard, smooth-edged material such as seeds, pebbles, sand, rice, and hard or soft plastic pellets such as polypropylene, Lucite, and polyethylene, respectively. For example, in the preferred embodiment of the invention rice is depicted in FIGS. 5, 6, and 7.

The decorative covering 162 may consist of any pigment such as paint, ink, or dye directly applied to the outside wall 40 of the hollow casing 26. This is shown in FIG. 6—Alternate Elongated Core—where no decorative covering 162 is depicted. The decorative covering 162 may also be formed of a thin layer of material such as wrapping paper, plastic decals, contact paper, etc. The decorative coverings 162 of paper, plastic, etc., where applicable, are secured to the hollow casing 26 by a suitable adhesive. In the preferred embodiment of the present invention a thin piece of wrapping paper 7½ inches wide and 3 feet in length cut to conform with the dimensions of the hollow casing 26 is rolled around the outside wall 40. FIG. 3—Rainmaker Assembly— shows the decorative covering 162 wrapped around the outside wall 40 of the hollow casing 26. The first and second edges 164 and 166 of the wrapping paper are secured to the hollow casing 26 by a suitable adhesive to form one finished seam which corresponds to the second edge 166 of the decorative covering 162.

The decorative tie 168 best shown in FIG. 1—Rainmaker—may be comprised of any tying means 170 such as jute, yarn, string, or plastic lacing which may be knotted and fashioned in a predetermitted pattern. A plurality of beads 172 and feathers 174 may be integrated into the decorative tie 168 for aesthetic appeal. For example, in the preferred embodiment of the present invention FIG. 1—Rainmaker—depicts a decorative tie 168 with beads 172 and feathers 174. The decorative tie 168 is secured to the hollow casing 26 by a conventional double knot 176. Alternatively the decorative tie 168 may be secured with a suitable adhesive.

Figure 8:
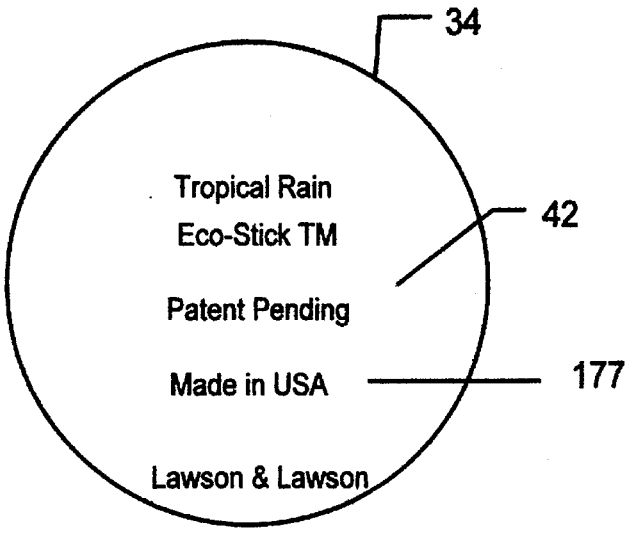
FIG. 8—Product Information—is a top view of the end closing means taken along lines 4—4 of FIG. 5.

FIG. 8—Product Information—shows text 177 depicting product trademark, manufacturer, and country of origin for a hand-made or manufactured simulated musical rainmaker 24 on the outside face 58 of the top 42 of end closing means 34.

Hand-Made Simulated Musical Rainmaker—Operation

The first and second end closing means 34 and 36, respectively, form a closed, hollow interior 132 with the casing 26. In the exemplary form of the simulated musical rainmaker 24, the end closing means 34 and 36 are pliable. The hairline indentations 62 and 64 on sleeves 46 and 48, respectively, help the user mold the sleeves 46 and 48 to the inside wall 38 of the hollow casing 26.

The elongated-core-baffle means 68 has three functions. First, the stiff outermost tab ends 140 give structural support to the hollow casing 26. Second, the plurality of tabs 114 projecting from the core 74 partition the hollow interior 132 of the casing 26 so that the particulate material 160 flows piecewise through the openings 134 of the elongated-core-baffle means 68. Third, the elongated-core-baffle means 68 creates a unique hissing or rushing sound identifiable as rain or water running from a faucet as friction of the particulate material 160 impinges on the elongated-core-baffle 68 to create a sound that can be heard externally to the casing 26.

The tabs 114 of the succeeding rows 124 of the elongated-core-baffle means 68 are struck by the particulate material 160 as such particulate material 160 flows from the first end 30 to the second end 32 of the casing 26.

In operation, it is desirable to have most of the particulate material 160 accumulate at one end, such as the second end 32, of the hollow casing 26. To achieve this goal the hollow casing 26 is oriented vertically with its first end 30 uppermost. Then the hollow casing 26 is inverted so that the second end 32 achieves a vertical uppermost position. A sound is generated when the particulate material 160 flows through the elongated-core-baffle-means 68 striking the paper tabs 114 and paper core 74.

When substantially all of the particulate material 160 has gathered at the second end 32 of the casing 26, such casing 26 may be inverted to cause the particulate material 160 to flow piecewise back to the first end 30 of the casing 26 through the openings 134 of the elongated-core-baffle means 68.

The quantity of particulate material 160 disposed in the hollow interior 132 of the casing 26 is dependent on the duration of the rain sound desired without making the rainmaker 24 too heavy. In the preferred embodiment, 1 cup of particulate material 160 is ideal.

The decorative tie 168 and decorative covering 162 serve as learning tools. Children learn to create patterns and designs by combining the tying means 170, beads 172, and feathers 174 so as to acquire hand coordination and craft-making skills. The children may draw their own designs, such as macaws, snakes, insects and leaves representing animals and plants from the rainforest, on the flat piece of paper which forms the decorative covering 162. The decorative covering 162 may have designs identical to the designs shown in FIG. 20—Molded Rainmaker.

The outside face 58 of the top 42 of the end closing means 34 shows text 177 depicting product trademark, manufacturer, and country of origin for a hand-made or manufactured simulated musical rainmaker to give information to the consumer purchasing the product.

Plastic Simulated Musical Rainmaker—Description

Another preferred embodiment of the present invention is an article of manufacture incorporating visual and aural enhancement which is represented in FIGS. 9–19.

In FIG. 9—Plastic Rainmaker—a clear, see-through casing 180 is comprised of first and second opposing closed ends 186 and 188, respectively. The clear casing 180 is formed of a single piece of hard molded plastic such as Lucite and polypropylene 2 inches in diameter and a predetermined thickness. The first and second ends 186 and 188 are tapered a predetermined amount by a length of 1 inch.

FIG. 11—Longitudinal View of Plastic Rainmaker—best shows the attachment of the end closing means 194 and 196. End closing means 194 and 196 are formed of a single piece of hard molded plastic such as Polypropylene or Lucite that is made of colored plastic and opaque. End closing means 194 has a top 200 two inches in diameter and a sleeve 206 one inch in length contiguous with the top 200 along the outermost edge 214 of top 200. The sleeve 206 conforms in cross sectional shape to the cross sectional shape of the clear casing 180. The first sleeve 206 of the top 200 of the end closing means 194 fits around the outside wall 184 of the first casing end 186. The top 200 of the end closing means 194 has three perforations going through the top 200 to allow the sound of rain to be heard externally to the casing 180.

Likewise, the second end closing means 196 has a top 204 and a sleeve 208 identical to end closing means 194. The second sleeve 208 of the top 204 of the end closing means 196 fits around the outside wall 184 of the second casing end 188.

FIG. 11 Longitudinal View of Plastic Rainmaker—shows the tapered ends 186 and 188 fitting into the end closing means 194 and 196, respectively.

Figure 11A:
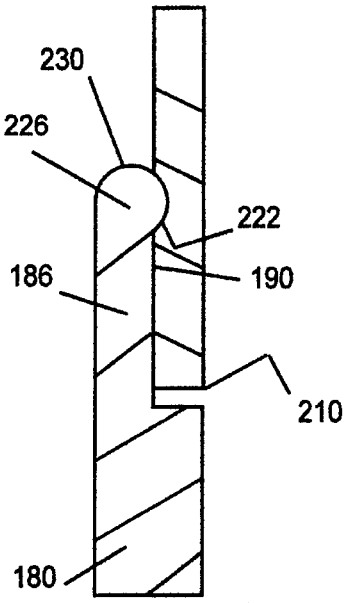

The first end closing means 194 is releasably mounted on the end 186 of the clear casing 180 by means of a round groove 222. The groove 222 is formed on the inside wall 190 of the first sleeve 206 of the top 200 of the first end closing means 194 which conforms with the ridge 226 formed on the outermost end 230 of the first end 186 of the clear casing 180. FIG. 11*a*—Closing Detail—shows the end closing means 194 fitting over the tapered end 186 with a groove 222 fitting over the ridge 226 formed on the outermost end 230 of the clear casing 180.

The second end closing means 196 is fixedly mounted on the end 188 of the clear casing 180 by means of a groove 224 and a ridge 228 identical to groove 222 and ridge 226 of the first end closing means 194. The end closing means 196 is secured to the end 188 by a suitable adhesive placed on the inside wall 190 of the sleeve 208 of the top 204 of second end closing means 196.

FIGS. 9, 10, and 11 depict another embodiment of the elongated-core-baffle means 68. FIG. 10—Mesh Loop—shows the detail of the elongated-core-baffle means 234. The third embodiment of the present invention, the elongated-core-baffle means 234, is formed of one piece of molded soft plastic. The elongated-core-baffle means 234 may also be used in the first embodiment of the present invention. Plastic mesh 236 is composed of a plurality of plastic threads 238, such as threads 240, 242, 244, 246, etc., intersecting each other to form rectangular-shaped ¼ inch openings 134 best shown in FIG. 10—Mesh Loop. The plastic mesh 236 is coiled symmetrically to form a plurality of loops 248, such as loops 250, 252, 254, etc., around a ⅛ inch circular-shaped plastic core 256 as shown in FIG. 11—Longitudinal View of Plastic Rainmaker. The plastic core 256 may be any suitable shape. The elongated-core-baffle means 234 is loosely, and centrally disposed in the hollow interior 132 of the clear casing 180 starting at the beginning 260 of the casing 180 at its largest diameter, goes through the second end 262 of the casing 180 at its largest diameter, and rests against the inside face 218 of the top 204 of the second end closing means 196. The outermost ends 258 of the loops 248 are a little less that 2 inches in diameter extending to and touching the inside wall 182 of the clear casing 180. The elongated-core-baffle means 234 occupies about 35 inches of the clear casing 180. The top 264 of the elongated-core-means 234 is aligned laterally with the outermost end 210 of the sleeve 206 of the top 200 of the first end closing means 194. The bottom 266 of the elongated-core-means 234 rests against the inside face 218 of the top 204 of the second end closing means 196.

In FIGS. 9 and 11 there is depicted colorful, fluorescent rice-shaped particulate material 268 made of polypropylene. The particulate material 268 is loosely and flowably disposed within the clear casing 180. The particulate material 268 is stored in the well 220 in the hollow interior 132 formed by the inside face 218 of the top 204 of the second end closing means 196 at the second end 188 of the clear casing 180.

Figure 14:
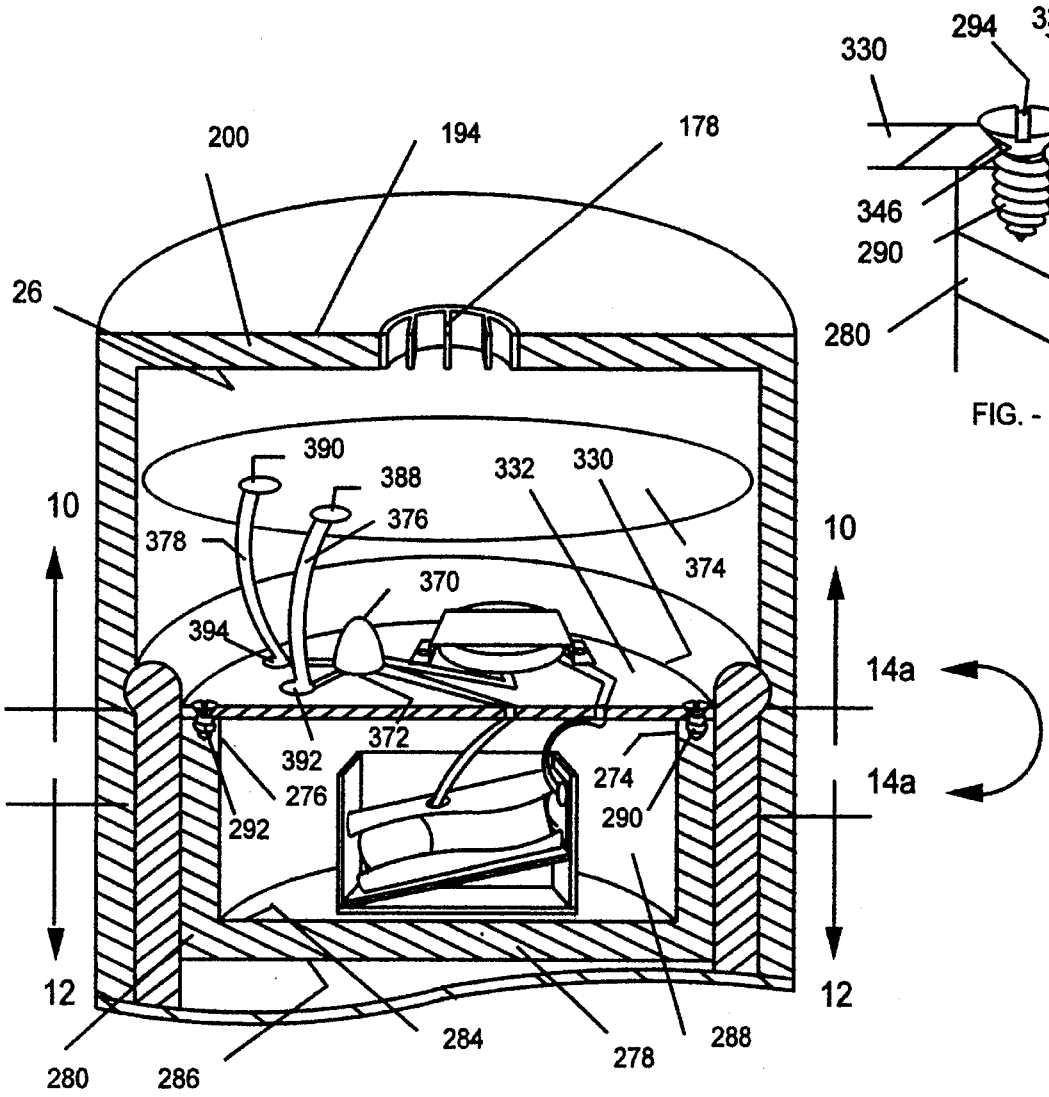
FIG. 14—Mounted View of Electronic Sounding Means and Motion Detector—is an enlarged, partial, cross sectional view of a circuit board with the holder and motion detector mount of a simulated musical rainmaker shown in FIG. 9 with FIG. 14*a* which is an enlarged, detailed, cross sectional view of the circuit board attachment to the holder of a simulated musical rainmaker shown in FIG. 9.

FIG. 14—Mounted View of Electronic Sounding Means and Motion Detector—best shows a plastic holder 272 mounted on the inside wall 182 of the first end 186 of the clear casing 180. The plastic holder 272 is made of one piece of molded hard plastic such as polypropylene or Lucite in a predetermined thickness. The plastic holder 272 has a plate 278 and a wall 280. The wall 280 of the plastic holder 272 is ½ inch in length and contiguous with the plate 278 of the plastic holder 272.The plastic holder 272 is mounted to the inside wall 182 of the first end 186 of the clear casing 180 by means of adhesive applied between the outside face 282 of the wall 280 and the inside wall 182 of the clear casing 180. The rim 298 of the wall 280 has two bored holes 290 and 292 aligned with each other at the sides 274 and 276 of the plastic holder 272. The bottom face 286 of the plate 278 is parallel to the outermost end 210 of the sleeve 206 when the end closing means 194 is properly mounter over the end 186 of the clear casing 180.

Between the inside face 216 of the top 200 of the first end closing means 194 and the inside face 284 of the plate 278 of the plastic holder 272 is formed a chamber 288 in which are mounted an electronic sounding means 328 and a motion detector 428.

Figure 12:
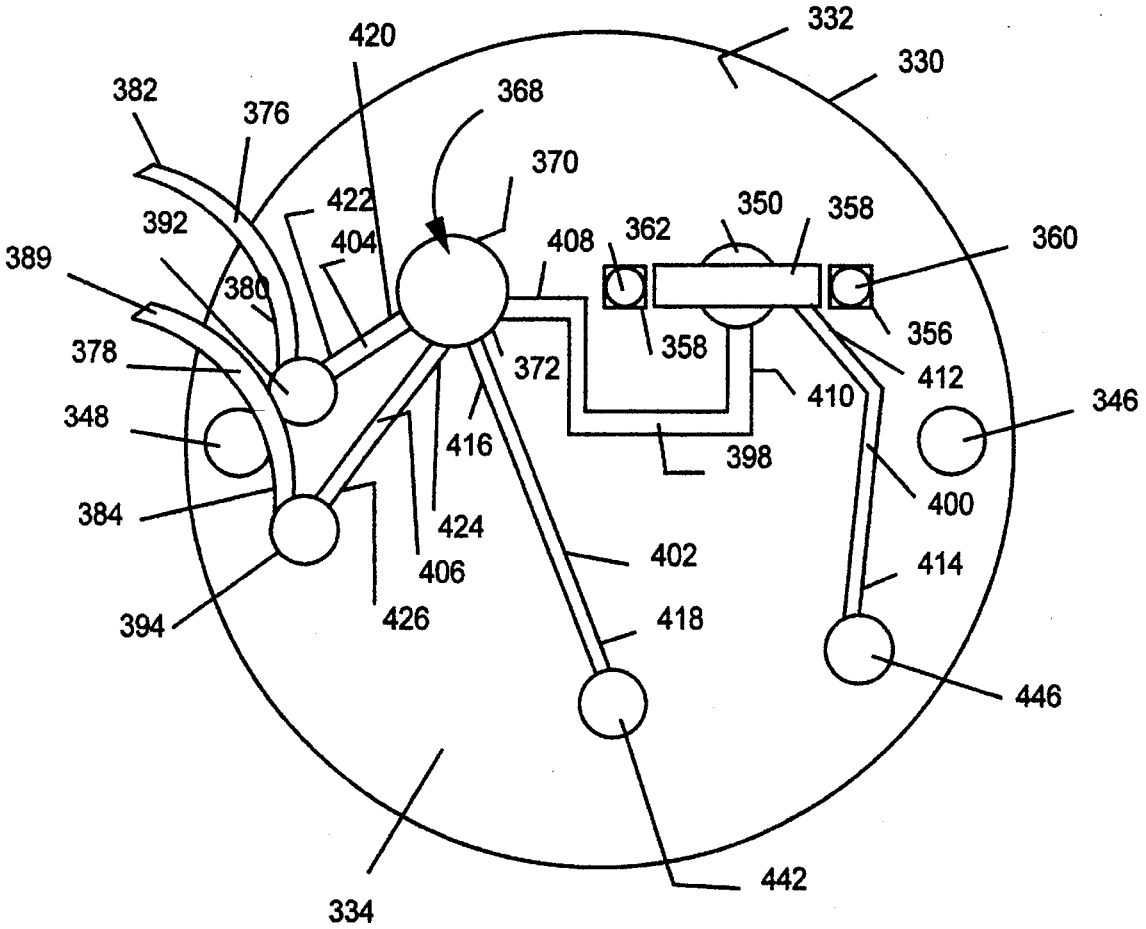
FIG. 12—Circuit Board—is an enlarged, cross sectional view of a circuit board of a simulated musical rainmaker taken along lines 8—8 of FIG. 11.

FIG. 12—Circuit Board—depicts a conventional circuit board 330 constituted of components and parts that produce a standard electronic sounding means 328. The circuit board 330 may also be formed of a standard circuit board with a plurality of standard components such as transistors and resistors. Alternatively the circuit board 330 may be formed of a conventional miniaturized sound IC (Integrated Circuit) 368 known in VLSI technology placed on a thin plastic wafer. In FIG. 12—Circuit Board Detail—a thin plastic wafer serves as the circuit board 330. The circuit board 330 has a small 1.5 volt battery 350, a sound IC 368, solder joints 392 and 394 to the speaker 374, and solder joints 442 and 446 to the motion detector 428 connected to the circuit board 330.

A plurality of connectors 396 connect the components of the electronic sounding means 328, such as the battery 350, the sound IC 368, the speaker 374, and the motion detector 428. All connectors 396 such as 398, 400, 402, 404, and 406 are made of a thin layer of conductive metal deposited on the top face 334 of the circuit board 330 by conventional methods.

The first end 408 of connector 398 connects to the sound IC 368. The second end 410 of the connector 398 connects to the battery 350.

The first end 412 of the second connector 400 is connected to the battery 350, while the second end 414 of the connector 400 is connected to the motion detector 428 going to the connector plate 462.

The first end 416 of the third connector 402 is connected to the sound IC 368, while the second end 418 of the connector 402 is connected to the motion detector 428 going to the metal cylinder 452.

The first end 420 of the fourth connector 404 is connected to the sound IC 368, while the second end 422 of the connector 404 is connected to the first end 380 of the first insulated wire 376 going to the speaker 374. The connection between the second end 422 of the connector 404 is secured to the first end 380 of the insulated wire 376 by solder joint 392.

The first end 424 of the fifth connector 406 is connected to the sound IC 368, while the second end 426 of the connector 406 is connected to the first end 384 of the insulated wire 378 going to the speaker 374. The second end 426 of the connector 406 connected to the first end 384 of the insulated wire 378 is secured by the solder joint 394.

The sound IC 368 is held on the circuit board 330 by a small plastic cap 370 which is glued down at the bottom rim 372 with a suitable adhesive.

FIG. 12—Circuit Board—shows the battery 350 secured to the circuit board 330. The battery 350 is a dry cell cadmium sulfide battery commonly used in cameras and watches. The battery 350 is held in place by a battery clamp 352 formed of a thin strip 354 of U-shaped metal conforming to the dimensions of the battery 350. The clamp 352 has two short feet 356 and 358, respectively, projecting outward and parallel to the top face 334 of the circuit board 330. The feet 356 and 358 each have holes 360 and 362, respectively, conforming with the dimensions of two small screws 364 and 366, respectively, used to fix the battery 350 with the battery clamp 352 to the top face 334 of the circuit board 330.

Figure 13:
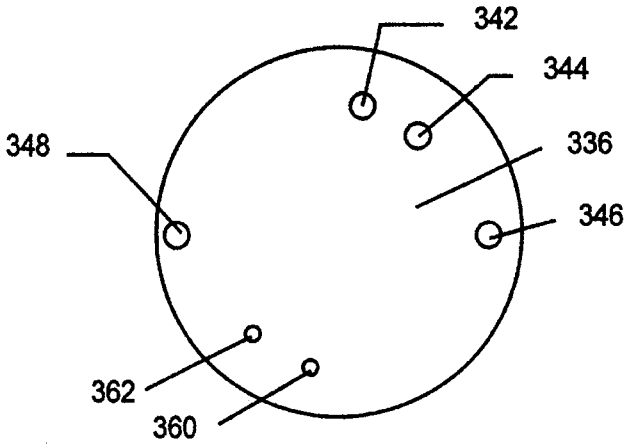
FIG. 13—Bottom of Circuit Board—is an enlarged, cross sectional view of the circuit board bottom taken along lines 10—10 of FIG. 14.

FIG. 13—Bottom of Circuit Board—shows holes 360 and 362 that allow the battery 350 to be secured to the top face 334 of the circuit board 330. Hole 338 allows connection between the top face 334 of the circuit board 330 and the insulated wire 430 to the metal cylinder 452. Hole 340 allows connection between the top face 334 of the circuit board 330 and the insulated wire 432 to the connector plate 462. Holes 346 and 348 of the circuit board 330 allow the circuit board 330 to be secured to the plastic holder 272.

FIG. 14—Mounted View of Electronic Sounding Means and Motion Detector—depicts an electronic sounding means 328 and a motion detector 428 mounted in the chamber 288 formed by the inside face 216 of the top 200 of the first end closing means 194 and the inside face 284 of the plate 278 of the plastic holder 272. The plastic holder 272 is inserted into the first end 186 of the clear casing 180 by one inch such that the bottom face 286 of the plate 278 of the plastic holder 272 aligns laterally with the outermost end 210 of the sleeve 206 of the top 200 of the first end closing means 194.

Figure 15:
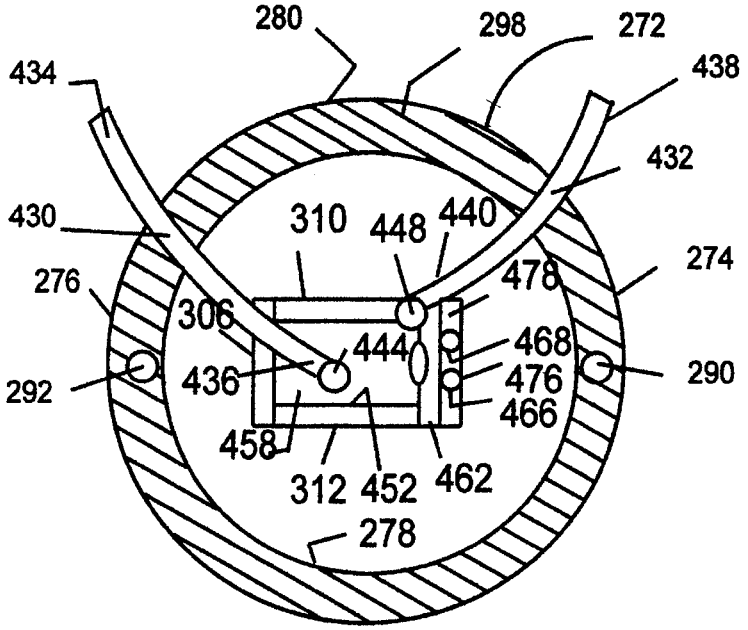
FIG. 15—Overview of Motion Detector Assembly—is an enlarged, cross sectional view of the motion detector and mount taken along lines 12—12 of FIG. 14.

FIG. 15—Overview of Motion Detector Assembly—shows the motion detector mount 300 centrally located on the inside face 284 of the plate 278 of the plastic holder 272 which is comprised of three adjacent rectangular walls 306, 310, and 312, respectively, projecting upward from the inside face 284 of the plate 278 of the plastic holder 272. The walls 306,310, and 312, respectively, measure about ½ inch in height to form cavity 324. The front wall 302 of the motion detector mount 300 conforms with the dimensions of the back wall 306 of the motion detector mount 300. The front wall 302 is spaced apart from the rectangular cavity 324 by a gap 314. The incline 318 at the bottom 326 of the cavity 324 located between the walls 306, 310, and 312, respectively, is inclined at a predetermined angle. For example, the incline 318 of the motion detector mount 300 depicted in FIG. 16—Detector Mount Detail—is inclined 5 degrees.

FIG. 14—Mounted View of Electronic Sounding Means and Motion Detector—shows the speaker 374 attachment. The speaker 374 is a standard miniaturized speaker about 1 inch in diameter fixed on the inside face 216 of the top 200 of the end closing means 194 with a suitable adhesive so as to allow the sound of rain to be broadcast externally to the clear casing 180. The speaker 374 is also connected to the top face 334 of the circuit board 330 by means of two insulated wires 376 and 378, respectively. The insulated wires 376 and 378 are connected at the speaker 374 by two solder joints 388 and 390, respectively, at the second ends 382 and 386 of the wires 376 and 378, respectively.

Figure 16:
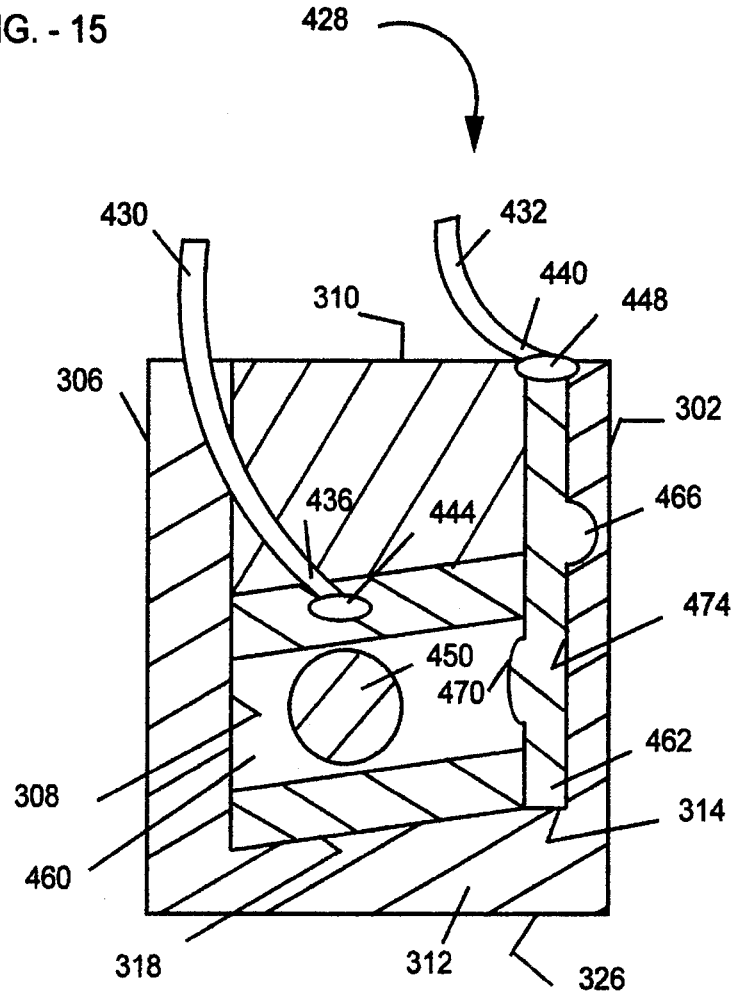
FIG. 16—Detector Mount Detail—is an enlarged, detailed, cross sectional view of the motion detector and mount of a simulated musical rainmaker shown in FIG. 9.
Figure 17:
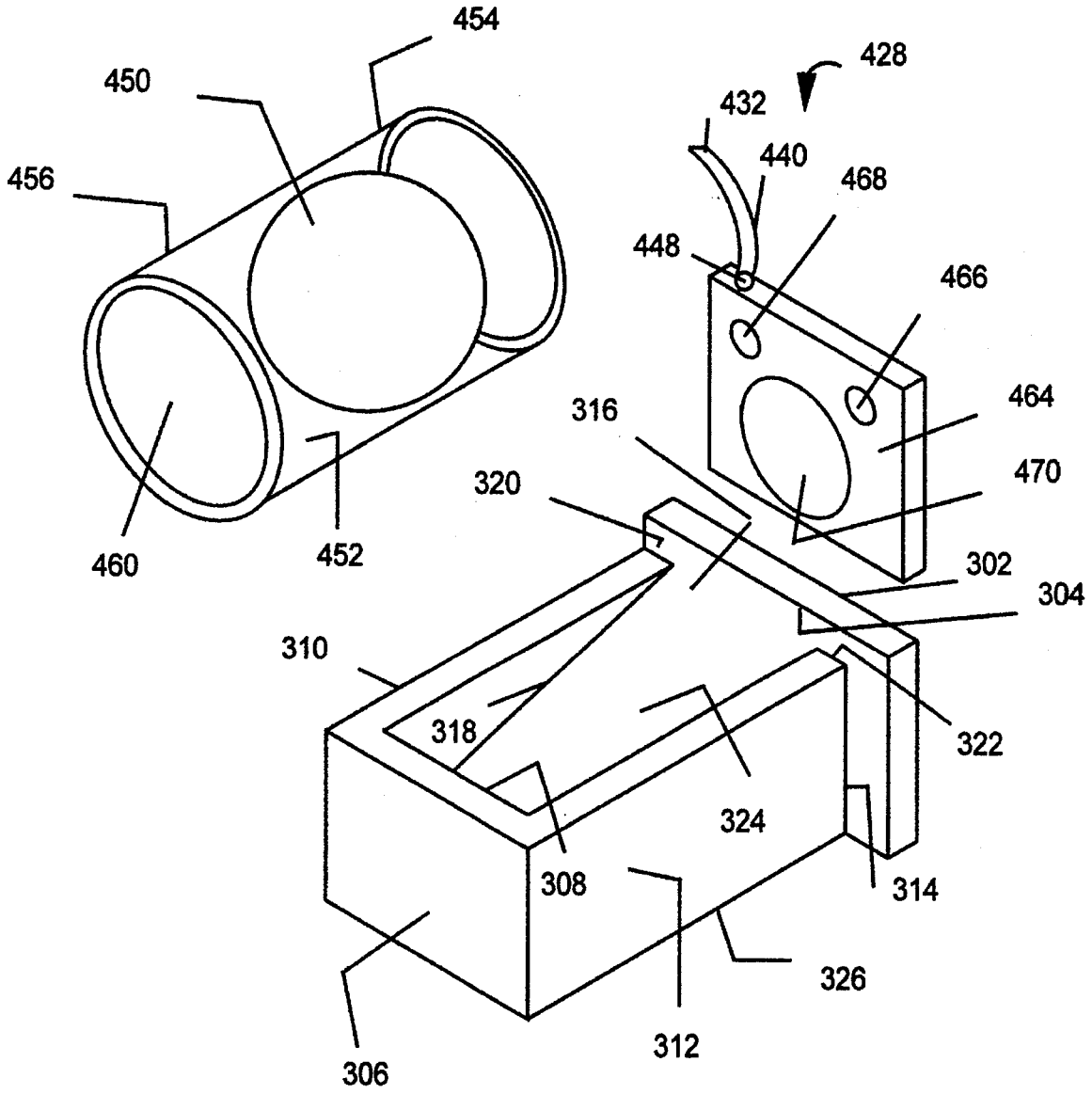
FIG. 17—Detector Mount Assembly—is an enlarged, detailed, perspective view of the motion detector and mount of a simulated musical rainmaker shown in FIG. 9.

FIG. 16—Detector Mount Detail—shows a motion detector 452 composed of a small metal cylinder 452 made of conductive metal. The metal cylinder 452 is a predetermined size conforming with the rectangular cavity 324 of the motion detector mount 300. The second end 456 of the metal cylinder 452 abuts the front face 308 of the back wall 306 of the motion detector mount 300. The first and second ends 454 and 456, respectively, of the metal cylinder 452 are cut diagonally to conform with the angle of the incline 318 of the bottom 326 of the cavity 324 of motion detector mount 300. A small ball bearing 450 of predetermined size of conductive metal is moveably disposed in the interior 460 of the metal cylinder 452. FIG. 17—Motion Detector Assembly— shows the assembly and disposition of the parts of motion detector 428.

The connector plate 462 is composed of a margin 464, a first dimple 466, a second dimple 468, and a connector pad 470. The connector plate 462 is inserted into the gap 314 of the motion detector mount 300 whereby the convex connector pad 470 on the back face 474 of the connector plate 462 protrudes into the first end 454 of the metal cylinder 452. The flat margin 464 surrounding the connector pad 470 is secured to the outermost ends 320 and 322 of the walls 310 and 312, respectively, of the motion detector mount 300. The connector plate 462 and dimples 466 and 468 conform in dimension to the open face 316 of the motion detector mount 300.

The two dimples 466 and 468 on the front face 472 of the connector plate 462 form two convex circles projecting outwardly toward the back face 304 of the front wall 302 of the motion detector mount 300. The connector plate 462 is secured to the first end 454 of the metal cylinder 452 by means of the convex surfaces 476 and 478, respectively, of the dimples 466 and 468 exerting pressure on the back face 304 of the front wall 302 of the motion detector mount 300.

The metal cylinder 452 of the motion detector 428 is connected to the circuit board 330 by first end 434 of an insulated wire 430 projected through the hole 342 of the bottom face 336 of the circuit board 330 and secured to the circuit board 330 by a solder joint 446. The second end 440 of the insulated wire 432 is connected to the outside wall 458 of the metal cylinder 452 at solder joint 444.

The plate connector 462 is connected to the circuit board 330 by an insulated wire 432 projected through a hole 344 in the bottom face 336 of the circuit board 330. The first end 438 of insulated wire 432 is connected to the circuit board 330 at solder joint 446. The second end 440 of insulated wire 432 is secured to the connector plate 462 by solder joint 448. The connector plate 462 is secured by means of the convex surfaces 476 and 478 of dimples 466 and 468, respectively, exerting pressure on the connector plate 462 over the open face 316 of the rectangular cavity 324.

Figure 14A:
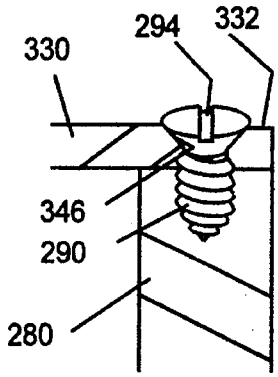

FIG. 14*a*—Circuit Board Attachment—shows the circuit board 330 attached to the plastic holder 272. The outermost edge 332 of the circuit board 330 projects over the rim 298 of the wall 280 by about 1/16 of an inch. The outermost edge 332 of the circuit board 330 is secured to the plastic holder 272 by screws 294 and 296 screwed through the holes 346 and 348, respectively, on the circuit board 330 and into the bored holes 290 and 292 of the rim 298 of the wall 280 of the plastic holder 272.

Figure 18:
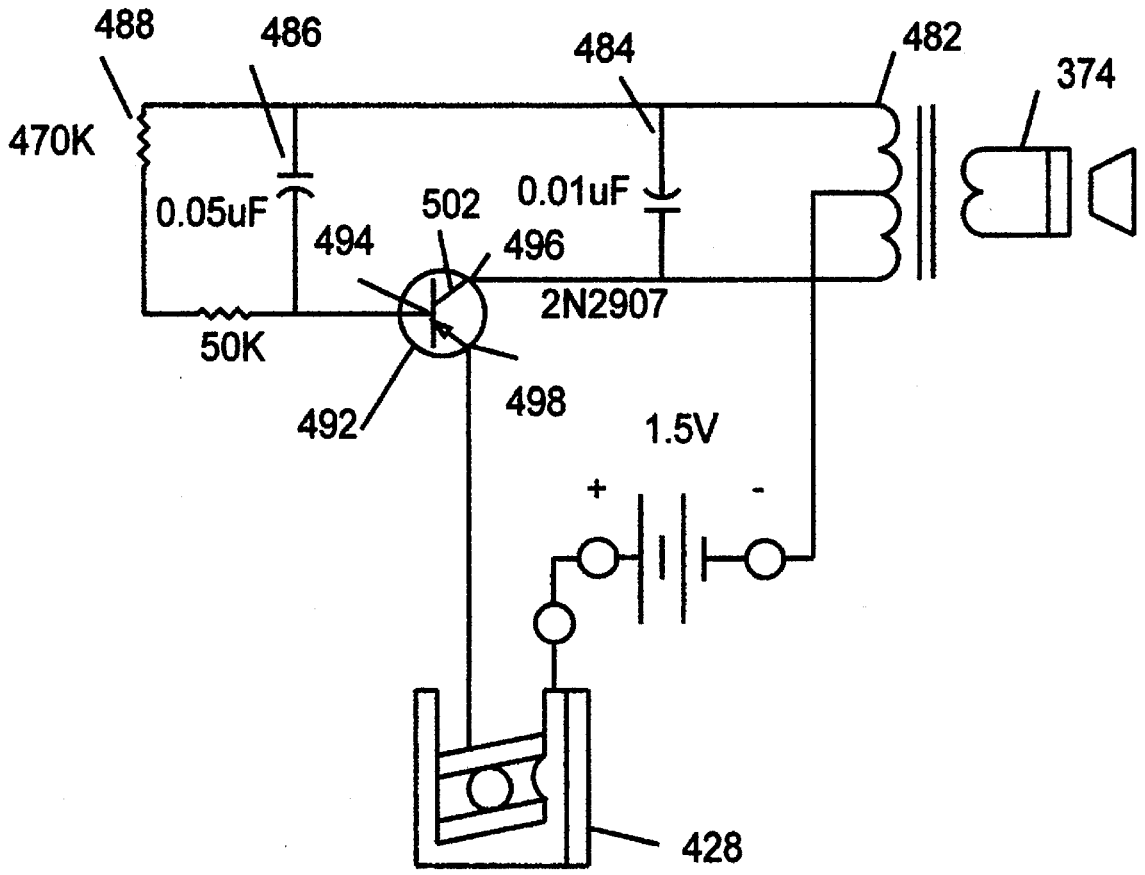
FIG. 18—Pulse Oscillator Circuit—is a schematic diagram of the Pulse Oscillator circuit used in the electronic sounding means of the simulated musical rainmaker shown in FIG. 9.

FIG. 18—Pulse Oscillator Circuit—shows a simple schematic of a pulse oscillator circuit that may be build of standard electronics parts such as those available in Radio Shack stores. The pulse oscillator circuit 480 has a 0.01 uF capacitor 484, a 0.05 uF base capacitor 486, a 470K resistor 488, a 50K resistor 490, a PNP Transistor (2N2907) 492, a 1.5 battery 350 as the power source 500, a motion detector 428, a speaker 374, and a transformer 482. The schematic makes use of standard electronics symbols except for the motion detector 428 which acts like a switch in the schematic. To denote the motion detector 428 in the schematic, the simplified outline of the motion detector mount 300 with the metal cylinder 452, ball bearing 450, and connector plate 462 was used.

The electronic sounding means 328 thus described may be incorporated in any simulated musical rainmaker 24 of any shape and dimension without the use of elongated-core-baffle-means 234, including any elongated-core-baffle means of any configuration.

Figure 19:
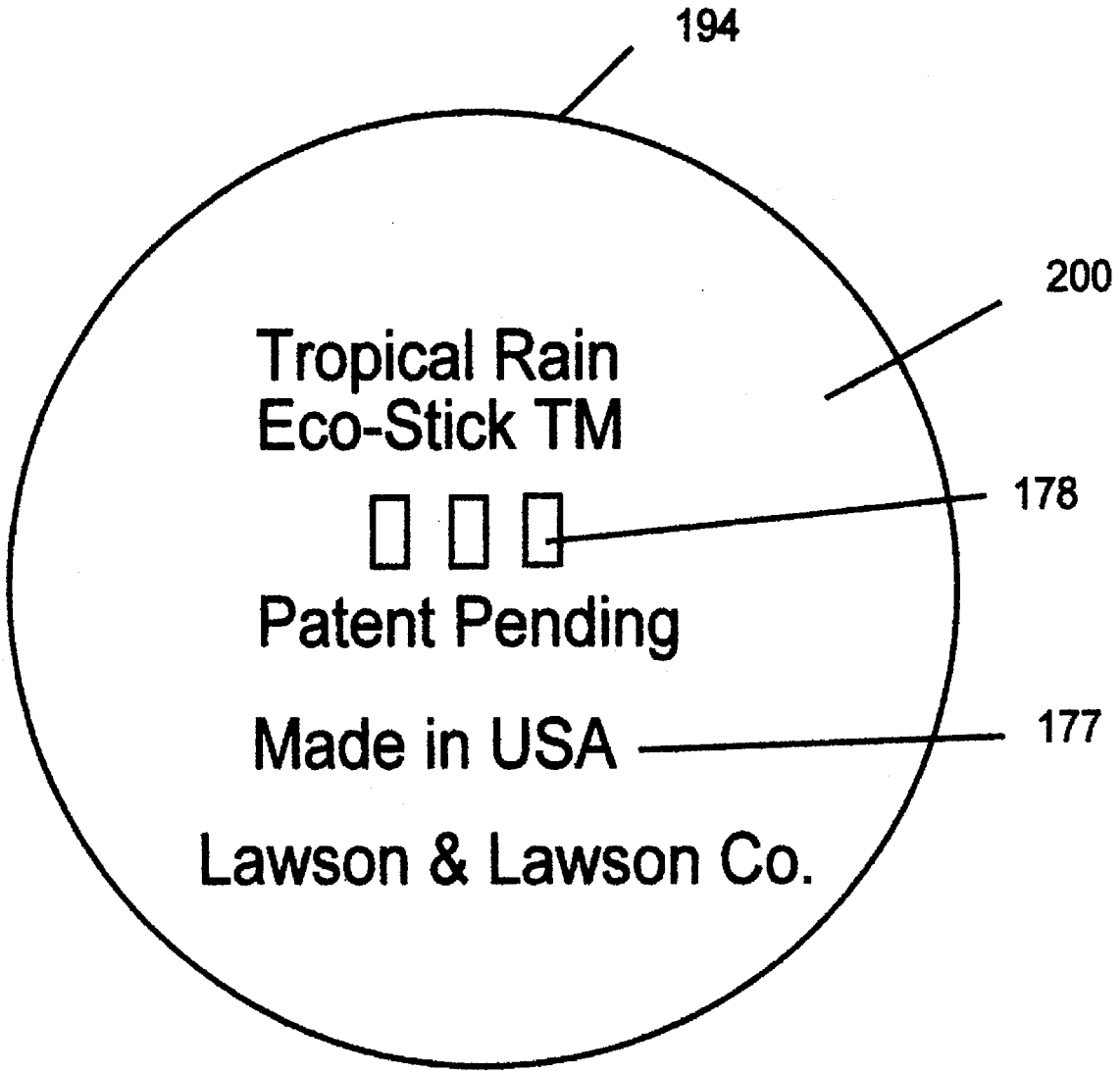
FIG. 19—Product Information—is a top view of the end closing means of a simulated music rainmaker taken along lines 14—14 of FIG. 11.

FIG. 19—Product Information for Plastic Rainmaker—is a cross sectional view of the top face 202 of the top 200 of the end closing means 194 taken along lines 14—14 of FIG. 11. Text 177 shows product trademark, manufacturer, and country of origin for a manufactured simulated musical rainmaker 24.

In FIG. 20—Molded Rainmaker—there is depicted the most preferred embodiment of an opaque casing 504. The opaque casing 504 consists of a hollow container 270 with a contiguous bottom 510 of molded plastic with 3-dimensional designs, such as designs depicting plant and animal life from the rainforest.

The opaque casing 504 has only one end closing means 506 which may be formed identically to end closing means 34 with the addition of perforations 178 to allow the sound of rain to be heard externally to the opaque casing 504. The end closing means 506 is secured to the hollow container 270 by means of pressure of a sleeve, such as sleeve 46, of the top 42 of end closing means 34 against the inside wall 512 of the hollow container 270. The inside wall 512 of the hollow container 270 has a flat circular surface for a predetermined distance to permit a plastic holder, such as plastic holder 272, to be inserted into the first end 514 of the hollow container 270.

Between the inside face 56 of the top 42 and the inside face 284 of the plastic holder 272 there is a chamber, such as chamber 288. In chamber 288 there is mounted an electronic sounding means and a motion detector, such as electronic sounding means 328 and motion detector 428.

Figure 21:
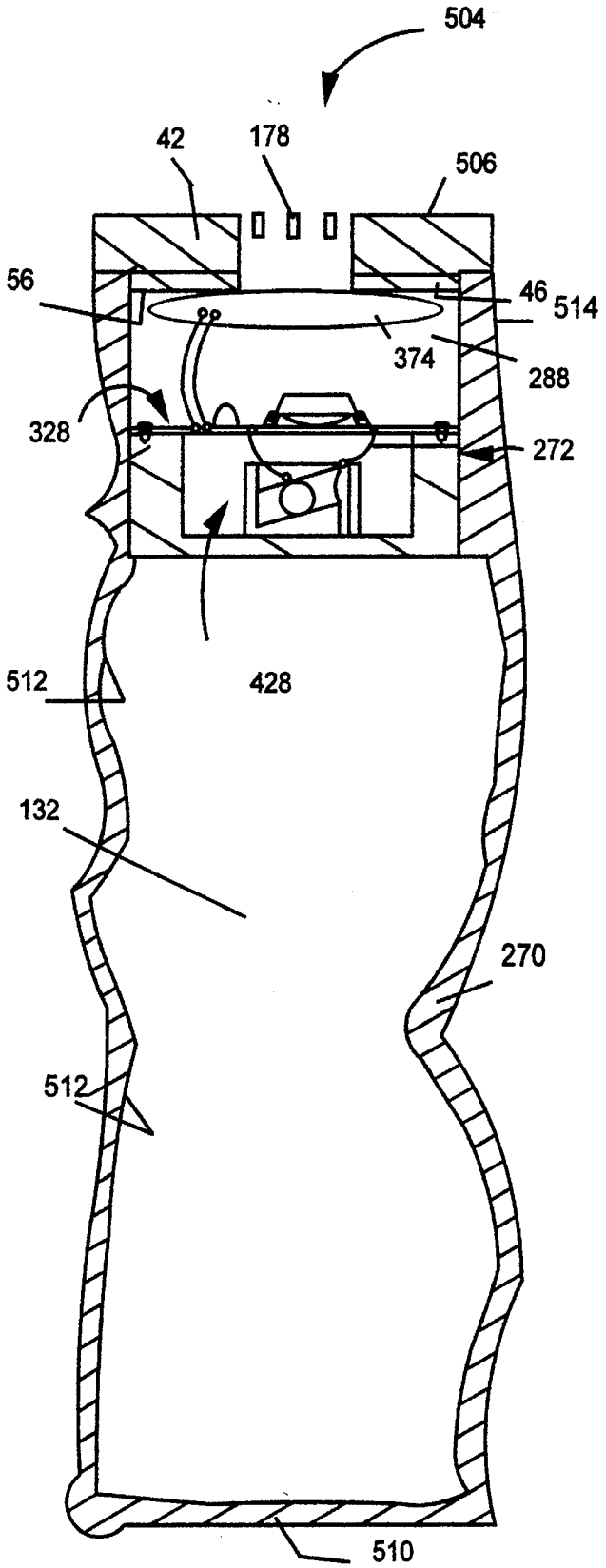
FIG. 21—Alternate Plastic Rainmaker—is a cross sectional longitudinal view of another embodiment of a plastic rainmaker shown in FIG. 9.

FIG. 21—Alternate Plastic Rainmaker—best shows an alternate plastic rainmaker 24 with an opaque casing 504. The rainmaker 24 has an electronic sounding means 328 inserted into the hollow interior 132 of the casing 504. No elongated-core-baffle means, such as elongated-core-baffle means 154 and 234 are needed. The opaque casing 504 may be any suitable length from 4 inches to 6 feet.

Plastic Simulated Musical Rainmaker—Operation

The operation of the second embodiment of the present invention is identical to the first embodiment in the majority of its parts and the mechanical action of the particulate material 268 flowing through the openings 134 of the elongated-core-baffle means 234.

The first and second end closing means 194 and 196, respectively, form a closed, hollow interior 132 with the casing 180.

In the second embodiment of the present invention, the grooves 222 and 224 and the ridges 226 and 228 fit within each other, respectively, and are used to secure the end closing means 194 and 196 to the casing 180 during manufacture. The round shape of the grooves 222 makes it possible for a user to pull off the end closing means 194 very easily during use of the invention. The user deforms the end 186 of the casing 180 by exerting inward pressure. Then the end closing means 194 can be easily pulled over the round shape of the ridge 226 on the end 230 of the casing 180 to permit the user to replace the battery 350.

The elongated-core-baffle means 234 has three functions. First, the outermost loop ends 256 give structural support to the clear casing 180 during heavy use. Second, the plurality of loops 248 of plastic mesh 236 projecting from the plastic core 258 partition the hollow interior 132 of the clear casing 180 so that the particulate material 268 flows piecewise through the openings 134 of the elongated-core-baffle means 234. Third, the elongated-core-baffle means 234 creates a unique hissing or rushing sound identifiable as rain or water running from a faucet as friction of the particulate material 268 impinges on the elongated-core-baffle 234 to create a sound that can be heard externally to the casing 180.

The elongated-core-baffle means 234 also has an aesthetic function. The elongated-core-baffle means 234 may be formed in symmetrical loops or any other interesting shape. The color of the elongated-core-baffle means 234 is chosen to contrast with the colors of the particulate material 268 thereby creating a dramatic effect as the colorful, rice-shape particulate material 268 flows by changing paths 158 through the openings 134 of the plastic mesh 236 of the elongated-core-baffle means 234.

In operation, it is desirable to have most of the particulate material 268 accumulate at one end, such as the second end 188 of the casing 180. To achieve this goal the clear casing 180 is oriented vertically with its first end 186 uppermost. Then the clear casing 180 is inverted so that the second end 188 achieves a vertical uppermost position. A sound is created by the friction of the particulate material 268 flowing through the openings 134 of the elongated-core-baffle-means 234 and striking the mesh 236 and plastic core 256 as such particulate material 268 moves from the first end 186 to the second end 188 of the clear casing 180.

When substantially all of the particulate material 268 has gathered at the second end 188 of the casing 180, such casing 180 may be reinverted to cause the particulate material 268 to flow piecewise back to the first end 186 of the casing 180 through the openings 134 of the elongated-core-baffle means 234.

The quantity of particulate material 268 disposed in the hollow interior 132 of the casing 180 is dependent on the dimensions of the well 220 located in the second end 188 of the casing 180. The well 220 formed by the second end 188 and the inside face 218 of the second closing means 196 is used for storing the particulate material 268 when the rainmaker 24 is held in an initial position with the first end 186 uppermost.

The electronic sounding means 328 enhances the sound created by the particulate material 268 flowing within the casing 180 by broadcasting the sound of rain, or animals and instruments, additionally, to the outside of the casing 180. The perforations 178 in the top 200 of the first end closing means 194 permit the sound of rain or animals and instruments, additionally, to be heard externally to the casing 180.

The plastic holder 272 has three functions: it hides the electronic sounding means 328 from view of the user and keeps it closed away from the intrusion of the particulate material 268 in the hollow interior 132 of the clear casing 180. The plastic holder 272 keeps in place all the parts of the electronic sounding mean 328 and the motion detector 428 which may be sensitive to shock when the invention is dropped during use. The plastic holder 272 secures the elongated-core-baffle means 234 in the clear casing 180 between the first and second ends 260 and 262 which shows the beginning and end of the clear casing 180 where the outside wall 184 has its greatest diameter.

The primary function of the wall 280 of the plastic holder 272 is to secure the circuit board 330 to the casing 180. The wall 280 and bottom face 286 of the plate 278 of the plastic holder 272 make a sturdy chamber 288 to protect the parts of the circuit 480 that may be sensitive to dust and condensation in the air.

The motion detector 428 activates the sound in the electronic sounding means 328. When the present invention is held vertically with its first end 186 held uppermost, the ball bearing 450 within the metal cylinder 452 of the motion detector 452 rests on the front face 308 of the back wall 306 of the motion detector mount 300. In this position, the circuit 480 is broken and no noise is emitted through the speaker 374 secured to the inside face 216 of the top 200 of the first end 186 of the end closing means 194. When the present invention is then tilted forward at an angle sufficient to overcome the incline 318 of the bottom 326 of the cavity 324, the ball bearing 450 rolls forward and rests on the connector pad 470 protruding into the metal cylinder 452 thereby completing the circuit 480 and activating the sound IC 368. If the present invention is propped up against an object, such as a wall or desk, with the second end 188 in an uppermost position, the present invention will broadcast the sound of rain externally to the casing 180 as long as there is a charge in the battery 350 to activate the circuit 480.

FIG. 18—Pulse Oscillator Circuit—shows a simple pulse oscillator circuit 480 well known by those learned in the art of electronics. The schematic was taken from a pulse oscillator circuit 480 built on a circuit board 330 with standard electronics parts such as those available in Radio Shack stores.

When a Transistor 492 is ON, the signal that the Transistor 492 generates through the Base-Emitter junction 502 produces a sound which can be heard through a speaker 374. The base capacitor 0.05 uF 486 quickly charges up during the Transistor 492 ON time, to a voltage greater than that of the battery 350. The 0.01 uF capacitor 484 is also charging up and feeding the base capacitor 486. Then during the Transistor 492 OFF time, the charge in the base capacitor 486 causes a positive voltage at the base 494 of the transistor 492 to turn the Transistor 492 OFF, until the 470K resistor 488 and the 50K resistor 490 discharge the voltage in the base capacitor 486 down to where the Transistor 492 can turn ON again.

The behavior of the circuit 480 causes the on and off pulse of the sound emitted through the speaker 374. The 0.01 uF capacitor 484 controls the frequency of the signal. Thus the circuit 480 produces a low-pitched oscillating pulse similar to a rain shower. As long as the ball bearing 450 is resting against the connector pad 470 of the back face 474 of the connector plate 462, a low-pitched oscillating pulse is emitted through the speaker 374 through the perforations 178 in the top 200 of the first end closing means 194.

In another embodiment of a plastic rainmaker 24 the hollow container 270 and the end closing means 506 forms a closed, hollow interior 132. The plastic holder 272 forms a sturdy casing in which the electronic sounding means 328 and the motion detector 428 are mounted. The electronic sounding means 328 broadcasts the sound of rain externally to the hollow container 270 when first end 514 of the hollow container 270 is tipped away from the vertical uppermost position. No elongated-core-baffle means, such as elongated-core-baffle means 154 and 234, are needed. The perforations 178 in the end closing means 506 allow the sound of rain to be heard externally to the casing 504.

The present invention has been shown and described herein in what is considered to be the most practical and preferred embodiments.

Several companies provide custom and off-the-shelf products made with 100% recycled material for a paper tube, a polyethylene end closing means, decorative covering, and organic particulate material suitable to make the first embodiment of the present invention: 1) The Packaging Store located at 1255 Howard Street, San Francisco, Calif. 94103, telephone: 415-558-8100. 2) International Rotex, Inc., P.O. Box 20697, Reno, Nevada 89515, telephone: (702) 356-8356, 3) Container Corporation of America, Jefferson Smurfit, 2600 De La Cruz Blvd., Santa Clara, Calif. (408) 496-5118. 4) Northern California Rice Growers Association, 916 South River Road, Sacramento, Calif. Broker: John Perrara, telephone: (916) 371-6941.

Two companies produce off-the-shelf decorative wrapping paper with recycled fibers. 1) EarthCare Paper, Inc. at (608) 223-4000. 2) Good Nature at (513) 254-4023. Two companies produce plain recycled paper suitable to be printed with custom designs: NationWide Paper of San Francisco, Calif., at (415) 586-9160 and Eco-Paque Zellerbach of San Francisco, Calif., at (415) 589-5577.

Several printers using recycled paper and soybean based inks include: Advanced Lithography, 201 Mendell Street, San Francisco, Calif. 94124 and House of Printing of Mountain View, Calif., at (415) 964-9701.

Companies that recycle plastics and produce custom molds are listed in the American Recycling Market, a handbook of manufacturers working with recycled materials. The address: American Recycling Market Inc., P.O. Box 577, Ogdenburg, N.Y. 13669. These references are unverified.

CONCLUSIONS, RAMIFICATIONS, AND SCOPE OF THE INVENTION

Thus the reader will see that the hand-made simulated musical rainmaker of the present invention provides a fanciful musical rainmaker for school-age children and people of almost any age. In its hand-made form the device is easy to make by persons with only basic craft skills, requires less time to complete than the prior art, relies on tools that are relatively safe, and produces no hazardous parts when the casing of the rainmaker begins to deteriorate. The device is disposable and recyclable, and constructed itself of reused or recycled materials. The present invention is lighter in weight than conventional rainmakers of the same length.

The invention is ideal for learning in such subjects as culture, music, literature, and plant and animal life of many ecological environments such as the tropical rainforest, the desert, and the north woods. The decorative covering or outside wall of the hollow casing may be used by children to draw their own designs to reinforce the lessons they have learned in the classroom. The present invention is a perfect toy to celebrate Earth Day, which is slowly becoming an important holiday in the calendar year.

Adults and children will also appreciate a plastic simulated musical rainmaker that has fanciful shapes and colors reflecting ecological environments that they read about in books, journals, and on television. The device is more durable than simulated rainmakers available to the present shown in the prior art. It is safe to use, lightweight, and economical to buy. Some parents and educators would rather buy a finished simulated musical rainmaker that is durable rather than make by hand a rainmaker when it is needed.

While my above description contains many specificities, these should not be construed as limitations on the scope of the invention, but rather as an exemplification of the preferred embodiments thereof. Many other variations are possible. For example, the first embodiment of the present invention does not require a decorative tie for the full functioning of the invention. In another embodiment the hollow casing may be formed like a long container with a contiguous bottom which requires only one closing means at the top.

The hand-made simulated musical rainmaker makes an ideal craft kit. In such a craft kit, the user would find all pieces to create the invention such as a hollow casing, two strips of paperboard for the elongated-core-baffle means, two end closing means, craft paper with a design printed on it, and particulate material such as polypropylene pellets. In addition, the kit could contain paint, paint brushes, yam, beads, and feathers. Alternatively, a rainmaker craft kit could supply only a subset of the necessary parts of the rainmaker. Such a craft kit would include the hollow casing, one or more end closing means, and an elongated-core-baffle means. The user would be required to furnish the other parts and craft supplies such as paint, glue, and paint brushes.

One embodiment of the elongated-core-baffle means may be a simple plastic form that is flat with threads shaped like a ladder. When the elongated-core-baffle means is inserted in spiral fashion into a hollow casing, the threads extended from one side of the casing to the other side imitating the structure of the rainmaker made with toothpicks. The elongated-core-baffle means thereby cuts down the time required to make a rainmaker.

The elongated-core-baffle means may be constituted of independent parts such as hard plastic springs which are loosely packed into the hollow interior to fill the entire length of the hollow casing. The plastic springs may move into different formations, yet allow the particulate material to flow through them as it flows from one end of the casing to the other end.

The sound IC may contain additional components which add features to the way the rain sound is produced. The rain sound may be delayed after the circuit is broken. The rain sound may be modulated to produce no sound for short predetermined intervals, to produce variable pitches in tone, etc. Many of these features are commonly known and used in VLSI technology.

Another embodiment of the present invention may include a rainmaker with one or more electronic sounding means or sound circuits which create the sounds of animals such as a macaw, monkey, lion, etc., nature sounds such as wind, or instrumentation such as flute or drums in combination with the rain sound.

The addition of the electronic sounding means to a simulated musical rainmaker makes it possible to manufacture a simulated musical rainmaker of many different shapes and sizes. For example, a short rainmaker one foot in length may be tipped end over end, yet maintain a relatively long rain sound since the sound is produced by an electronic sounding means. The present invention may be miniaturized such as in a key chain or party favor for children without diminishing the duration of the rain sound.

The electronic sounding means used in an opaque casing makes the elongated-core-baffle means redundant. A very simple simulated musical rainmaker may include only a hollow casing or hollow container, one or more closing means, the electronic sounding means, and a motion detector.

Many different motion detectors may be devised and implemented to activate the rain sound. Motion detectors operate from light sensing, infra-red proximity, and other means, etc. For example, the electronic sounding means and motion detector may be devised to produce the sound of rain as soon as the casing is set in motion, but not necessarily tipped over.

Accordingly, the scope of the invention should not be limited to the embodiments illustrated, but by the appended claims and their legal equivalents.

What I claim is:

1. A simulated musical rainmaker comprising:

a hollow paper casing having an inside wall and closed first and second opposing ends, a colorful elongated-core-baffle means comprising a plurality of strips folded to form tabs that extend outward from said elongated-core-baffle means, said elongated-core-baffle means is loosely disposed in an interior of said hollow casing along the entire length of said casing, said tabs thereby break the fall of particulate material disposed within said rainmaker, first and second end closing means mounted on said first and second opposed ends, a thin decorative covering secured on an outside wall of said casing.

said particulate material is movable such that when said rainmaker is disposed at an angle away from horizontal, said particulate material flows through said elongated-core-baffle means simulating the sound of falling water; and wherein said casing is elongated and includes a contiguous bottom.

2. The simulated musical rainmaker of claim 1 wherein:

said casing is molded with an irregular cross section.

3. The simulated musical rainmaker of claim 1 wherein:

said decorative covering is a pigmented fluid deposited on said outside wall of said casing.

4. A simulated musical rainmaker comprising:

a hollow clear plastic casing having an inside wall and closed first and second opposing ends, an elongated-core-baffle means loosely disposed in an interior of said casing and extending along the length of said casing such that outermost ends of said elongated-core-baffle means extend toward the inside wall of said casing and thereby break the fall of particulate material disposed within said rainmaker, first and second end closing means mounted on said first and second opposed ends, a plastic holder secured to said casing, at least one electronic sounding means comprising a circuit board, a sound IC, a battery, a speaker, a motion detector, and connectors and wires to connect components of a pulse oscillator circuit mounted on said plastic holder, loose colorful particulate material loosely disposed within said casing such that when said rainmaker is disposed at an angle away from horizontal, said particulate material flows through said elongated-core-baffle means simulating the sound of falling water; and wherein said casing is elongated and includes a contiguous bottom.

5. The simulated musical rainmaker of claim 4 wherein:

said casing is molded with an irregular cross section.

6. The simulated musical rainmaker of claim 4 wherein:

said first and second end closing means are made of clear plastic.

7. The simulated musical rainmaker of claim 4 wherein:

said electronic sounding means are secured to said inside wall of said casing.

* * * * *